US007316474B2

(12) United States Patent
Tatsumi et al.

(10) Patent No.: US 7,316,474 B2
(45) Date of Patent: Jan. 8, 2008

(54) SURFACE TREATMENT APPARATUS AND IMAGE RECORDING APPARATUS

(75) Inventors: Setsuji Tatsumi, Kanagawa (JP); Hiroshi Ishizuka, Kanagawa (JP); Yasuhiko Kachi, Kanagawa (JP); Eiichi Kito, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 146 days.

(21) Appl. No.: 10/712,056

(22) Filed: Nov. 14, 2003

(65) Prior Publication Data

US 2004/0095451 A1 May 20, 2004

(30) Foreign Application Priority Data

Nov. 18, 2002 (JP) ..... 2002-334236
Nov. 18, 2002 (JP) ..... 2002-334238
Nov. 18, 2002 (JP) ..... 2002-334240
Mar. 13, 2003 (JP) ..... 2003-068370

(51) Int. Cl.
*B41J 2/01* (2006.01)

(52) U.S. Cl. ..... 347/101; 347/103; 347/105

(58) Field of Classification Search ..... 347/102, 347/101, 103, 105; 428/32.1, 195; 400/629
See application file for complete search history.

(56) References Cited

U.S. PATENT DOCUMENTS 5,764,262 A * 6/1998 Wu et al. ..... 347/101
6,332,679 B1 * 12/2001 Higuma et al. ..... 347/102

FOREIGN PATENT DOCUMENTS

EP 1407893 A2 * 4/2004
JP 60-072776 4/1985
JP 62-234980 10/1987
JP 02-079847 3/1990
JP 05-016492 1/1993
JP 05-053288 3/1993

(Continued)

OTHER PUBLICATIONS

Japanese Office Action dated Oct. 17, 2006.

(Continued)

*Primary Examiner*—Stephen Meier
*Assistant Examiner*—Ly Tran
(74) *Attorney, Agent, or Firm*—Whitham Curtis Christofferson & Cook, PC

(57) ABSTRACT

The present invention provides a surface treatment apparatus containing a sheet heating unit for heating a sheet, a sheet cooling unit for cooling the sheet. The apparatus satisfying at least one of following conditions:

(1) the apparatus transfers a surface quality of the contact member to a surface of the image recording layer and an interface of the thermoplastic resin layer facing the image recording layer of the sheet;
(2) the apparatus further contains the contact member selecting unit which selects the contact member having a desired surface quality;
(3) the apparatus further comprises a treatment control unit which controls treatment conditions of at least one of the sheet heating unit and the sheet cooling unit; and
(4) the sheet heating unit includes a sheet preheating part preheating the sheet and the apparatus transfers a surface quality of the contact member to the sheet heated by the sheet preheating part.

7 Claims, 21 Drawing Sheets

FOREIGN PATENT DOCUMENTS

| | | |
|---|---|---|
| JP | 06-194816 | 7/1994 |
| JP | 07-311506 | 11/1995 |
| JP | 8 305210 | 11/1996 |
| JP | 10-086420 | 4/1998 |
| JP | 2000 0241893 | 9/2000 |
| JP | 2001-053943 | 2/2001 |
| JP | 2001-285546 | 10/2001 |
| JP | 2001 328248 | 11/2001 |
| JP | 2002 079847 | 3/2002 |
| JP | 2002 234246 | 8/2002 |
| JP | 2002-274024 | 9/2002 |
| JP | 2002-292854 | 10/2002 |
| JP | 2006 194816 | 7/2006 |

OTHER PUBLICATIONS

Two Office Actions issued by the Japanese Patent Office on Feb. 13, 2007 and Feb. 27, 2007, pp. 1 to 5.

Office Action issued by the Japanese Patent Office on May 29, 2007, pp. 1-4 "Photographic Engineering—Silver Hlide Photography" by The Society of Photographic Science and Technology of Japan 1978, published by CORONA Publishing Co., Ltd. with an English language translation, pp. 1 to 11.

* cited by examiner

FIG. 15

```
// Surface treatment control
Luster_level=1
 {
   Surface=YES        // Pass through surface treatment apparatus YES
   Temp_A=120         // Roller A temperature
   Temp_B=80          // Roller B temperature
   Temp_B_cont=120    // Temperature for continuous printing by roller B
   Press=High         // Inter-roller pressure
   Cooling_fan=High   // Cooling fan capacity
   Belt=Long          // Cooling belt length
   Speed=Middle       // Transport speed
}
Luster_level=2
 {
   Surface=YES        // Pass through surface treatment apparatus YES
   Temp_A=120         // Roller A temperature
   Temp_B=80          // Roller B temperature
   Temp_B_cont=120    // Temperature for continuous printing by roller B
   Press=High         // Inter-roller pressure
   Cooling_fan=Low    // Cooling fan capacity
   Belt=Short         // Cooling belt length
   Speed=Middle       // Transport speed
}
Luster_level=3
 {
   Surface=NO         // Pass through surface treatment apparatus YES
}
```

FIG. 16

```
                    .
                    .
// Surface treatment control
Luster_level = 1
  {
    MAGAZINE = A
}
Luster_level = 2
  {
    MAGAZINE = B
    MAGAZINE = C
}
Luster_level = 3
  {
    MAGAZINE = Z
}
```

⇩

```
MAGAZINE = A → Luster_level = 1
  {
    Surface=YES        // Pass through surface treatment apparatus  YES
    Temp_A=120         // Roller A temperature
    Temp_B=80          // Roller B temperature
    Temp_B_cont=120    //Temperature for continuous printing by roller B
    Press=High         // Inter-roller pressure
    Cooling_fan=High              // Cooling fan capacity
    Belt=Long          // Cooling belt length
    Speed=Middle       // Transport speed
}
MAGAZINE = B,C → Luster_level = 2
  {
    Surface=YES        // Pass through surface treatment apparatus  YES
    Temp_A=120         // Roller A temperature
    Temp_B=80          // Roller B temperature
    Temp_B_cont=120    // Temperature for continuous printing by roller B
    Press=High         // Inter-roller pressure
    Cooling_fan=Low    // Cooling fan capacity
    Belt=Short         // Cooling belt length
    Speed=Middle       // Transport speed
}
                    .
                    .
MAGAZINE = Z → Luster_level = 2
  {
    Surface=NO         // Pass through surface treatment apparatus  YES
}
```

FIG. 18A

Paper selection

1. Paper A
2. Paper B
3. Paper C
4. Paper D

.
.

FIG. 18B

Luster selection

1. High gloss
2. Medium gloss
3. Matt
4. No treatment

.
.

SURFACE TREATMENT APPARATUS AND IMAGE RECORDING APPARATUS

BACKGROUND OF THE INVENTION

1. Field of the Invention

The present invention relates to a surface treatment apparatus and this surface treatment apparatus which easily and efficiently gives desired surface qualities to an image print obtained by various kinds of image recording methods, and to an image recording apparatus provided with this surface treatment apparatus.

2. Description of the Related Art

In the past, images have been formed by various methods such as silver halide photography, heat developing, inkjet recording, thermosensitive recording and electrophotography. In the prior art, techniques for controlling the gloss of image prints obtained by these various methods were not well-known.

However, Japanese Patent Application Laid-Open (JP-A) No. 05-053288 discloses a photographic apparatus which, in addition to a processor part which produces a printed photograph by developing a printing paper which has been bake-exposed, also comprises a drying part and surface texture treatment part to finish the printed photograph. The surface texture treatment part of this photographic apparatus comprises a pressure roller having surface depressions and protrusions which forms a predetermined surface texture on the printed photograph surface, and a shift mechanism which sets this pressure roller in a state where it can be pressed against the printed photograph. As a result, printed photographs having a desired surface texture can easily be obtained without replacing printing papers or interrupting the bake-exposure.

However, the surface texture treatment part in this photographic apparatus described in the aforesaid JP-A No. 05-053288 had a construction wherein the printed photograph surface was pressed by a pressure roller having a desired transfer roughness, and the depressions and protrusions on the pressure roller surface were transferred to the printed photograph. The surface texture treatment part of this photographic apparatus was adapted for use only with silver halide photographic sheets. Also, to obtain particular surface textures, it was necessary to provide a number of rollers having surface roughness for each texture, so in practice only about 1 to 3 surface textures could be realized. Therefore, according to JP-A No. 05-053288, only one type of treatment could be performed, there was no systematic generality, and performance was unsatisfactory from the viewpoints of working efficiency and energy efficiency. In the aforesaid JP-A No. 05-053288, the image recording layer is surface-treated by applying heat and pressure, but there is no mention of the surface treatment of the thermoplastic resin layer and even if the surface treatment of only the image recording layer surface is performed, the surface (interface) depression-and-protrusion shape pattern of the thermoplastic resin layer situated underneath may affect the image recording layer surface due to a time-dependent variation, so a desired depression-and-protrusion shape pattern is not obtained.

In JP-A No. 2001-053943, an image recording system was proposed wherein color information and gloss information are acquired from an image, and image recording is performed on a recording medium based on these two types of image information. Image recording is performed by converting gloss information or non-gloss information into the thermal energy of a thermosensitive head.

In the aforesaid JP-A No. 05-053288 and JP-A No. 2001-053943, the image recording layer is surface-treated by applying heat and pressure, but there is no mention of the surface treatment of the thermoplastic resin layer and even if the surface treatment of only the image recording layer surface is performed, if the surface (interface) depression-and-protrusion shape pattern of the thermoplastic resin layer situated underneath is not formed in a desired depression-and-protrusion pattern, it may affect the image recording layer surface due to a time-dependent variation, so a desired depression-and-protrusion shape pattern is not obtained.

Moreover, if a contact member is released from the sheet at high temperature, the depression-and-protrusion pattern on the contact member transferred to the thermoplastic resin layer and image-forming layer sometimes produced an undesirable plastic deformation due to external factors. Moreover, if a surface coating layer (transparent clear layer) is provided to improve the gloss as described in the aforesaid JP-A No. 2001-053943, it led to higher costs. Moreover, in the aforesaid related art, there is no mention of forming desired surface qualities in sheet units or within one sheet by adjusting at least one of pressure and temperature, so this was difficult to realize.

On the other hand, an electrophotography printing apparatus comprising a thickness detection unit to detect the thickness of a recording material, and a gloss detection unit to detect the surface gloss of the recording material, wherein the fixing conditions of a fixing apparatus are varied according to the output values of these units, has been proposed (JP-A No. No. 07-311506). However, in this case, an image print is not separated after fully cooling after fixing, so surface gloss was insufficient. Moreover, when this was applied to the photographic print of a silver halide photograph, blisters occur in the photograph print.

Therefore, a surface treatment apparatus or image recording apparatus which can perform a suitable surface treatment according to the kind of image print or paper, and can easily obtain an image having a desired glossiness, is not yet known.

Objects and Advantages

It is therefore an object of the present invention to provide a surface treatment apparatus which can efficiently impart desired surface qualities to the image print obtained by various kinds of image recording methods, and an image recording apparatus comprising this surface treatment apparatus which can easily form an image having different surface qualities in part or in whole.

SUMMARY OF THE INVENTION

The surface treatment apparatus of the present invention comprises a sheet heating unit to heat a sheet having at least a thermoplastic resin layer and an image recording layer on a base, and a sheet cooling unit to cool the aforesaid sheet when the aforesaid sheet is in contact with a contact member, and is characterized by at least one of conditions (1) to (4) wherein condition (1) is that the apparatus transfers a surface quality of the contact member to a surface of the image recording layer and an interface of the thermoplastic resin layer facing the image recording layer of the sheet;

condition (2) is that the apparatus further comprises the contact member selecting unit which selects the contact member having a desired surface quality from a plurality of contact members having different surface qualities;

condition (3) is that the apparatus further comprises a treatment control unit which controls treatment conditions of at least one of the sheet heating unit and the sheet cooling unit; and condition (4) is that the sheet heating unit includes a sheet preheating part which preheats the sheet and the apparatus transfers a surface quality of the contact member to the sheet heated by the sheet preheating part.

In the surface treatment apparatus described in (1), the sheet heating unit heats the sheet to be surface-treated. The sheet cooling unit cools the treated surface of the sheet while it is in contact with the aforesaid contact member. For this reason, when the sheet is separated from this sheet cooling unit, the surface qualities of the contact member are transferred to the surface of the sheet. As a result, by superimposing the contact member on the sheet, applying heat and pressure, cooling, and separating the sheet, surface treatment of the sheet which gives a desired luster can be efficiently performed without interrupting operations in any way, not only very efficiently on the image recording layer surface but also efficiently at the interface between the thermoplastic resin layer and image recording layer, without performing batch processing. If the image recording layer is somewhat transparent, the reflected light which is reflected at the interface with the thermoplastic resin layer on the image recording layer side affects the gloss, so the depression-and-protrusion shapes at the interface with the thermoplastic resin layer on the image recording layer side are an important factor in the gloss.

The surface treatment apparatus described in the aforesaid (2) comprises the contact member selecting unit which selects the contact member having a desired surface quality from among plural contact members having different surface qualities, the sheet heating unit which heats the sheet comprising at least the thermoplastic resin layer, and the sheet cooling unit which cools the sheet while it is in contact with the contact member. In the surface treatment apparatus of the present invention, the contact member selecting unit selects a contact member having a desired surface quality from among plural contact members having different surface qualities. For this purpose, a contact member having a surface quality which satisfies user requirements is selected, and the sheet is surface-treated using this contact member. The sheet heating unit heats the sheet to be surface treated, and brings the sheet treatment surface in contact with the contact member. Thus, the sheet is heated while it is in contact, and the surface state of the contact member is transferred to the sheet. The sheet cooling unit cools the sheet treatment surface while it is in contact with the contact member. Therefore, when the sheet is separated from the sheet cooling unit, the surface quality of the contact member is transferred to the sheet surface. As a result, by superimposing the contact member selected by the contact member selecting unit on the sheet, applying heat and pressure, cooling and separating, a desired surface quality selected from a gloss surface, matt surface and embossed surface, can be freely formed on the sheet without interrupting operations, and very efficiently without batch processing.

In the surface treatment apparatus of the aforesaid (3), the sheet heating unit heats the sheet to be surface treated. The sheet cooling unit cools the sheet treatment surface while it is in contact with the contact member. Consequently, when the sheet is separated from the sheet cooling unit, the surface quality of the contact member is transferred to the sheet surface. At this time, the surface treatment apparatus comprises the aforesaid treatment control unit, and treatment conditions in at least one of the sheet heating unit and sheet cooling unit are controlled. As a result, a desired gloss can easily and simply be imparted to the surface regardless of the sheet type.

In the surface treatment apparatus of the aforesaid (4), the sheet heating unit comprises a sheet preheating part which preheats the sheet, and the contact member is brought in contact with the sheet preheated by this sheet preheating part to transfer the surface quality. Hence, the sheet treatment surface can be brought to the softening and melting state before the surface quality of the contact member is transferred to the sheet, so the surface quality of the contact member can be efficiently transferred to (formed on) the sheet even under a relatively low pressure force. The sheet cooling unit cools the sheet while the sheet treatment surface is in contact with the contact member. Consequently, when the sheet is separated from the sheet cooling unit, the surface quality of the contact member is transferred to (formed on) the sheet surface. As a result, in the sheet preheating part, after heating the sheet treatment surface to the state in which it easily deforms plastically, by superimposing a contact member having a desired surface quality on the sheet, applying heat and pressure, cooling and separating, a desired surface quality selected from among gloss, matt and embossed can be freely formed without interrupting operations in any way, and very efficiently without batch processing, on a sheet (image print) obtained by various image recording methods such as silver halide photography, hot developing, inkjet recording, thermosensitive recording and electrophotography.

An image recording apparatus according to a first aspect of the present invention comprises an image recording unit which forms an image on a sheet, and the surface treatment unit of the present invention which performs surface treatment on the sheet whereupon an image has been formed by the image recording unit. In the image recording apparatus of the present invention, the application of heat and pressure by the surface treatment apparatus is performed immediately after the heating of the image recording process. As the sheet is in a state where it has been preheated by the image recording process, energy efficiency is increased by using preheating.

An image recording apparatus according to a second aspect of the present invention comprises the surface treatment unit of the invention which performs surface treatment of the sheet, and an image recording unit which records an image on the sheet which has been surface-treated by the surface treatment unit. The image recording apparatus of the present invention performs image recording on a surface-treated sheet, so a print can be obtained with a desired surface treatment of an economical sheet.

BRIEF DESCRIPTION OF THE DRAWINGS

FIG. 15 is a diagram showing an example of a treatment mode in the surface treatment apparatus of the present invention.

FIG. 16 is a diagram showing another example of a treatment mode in the surface treatment apparatus of the present invention.

FIGS. 18A and 18B are diagrams showing examples of a screen display in the surface treatment apparatus of the present invention.

Figure 1:
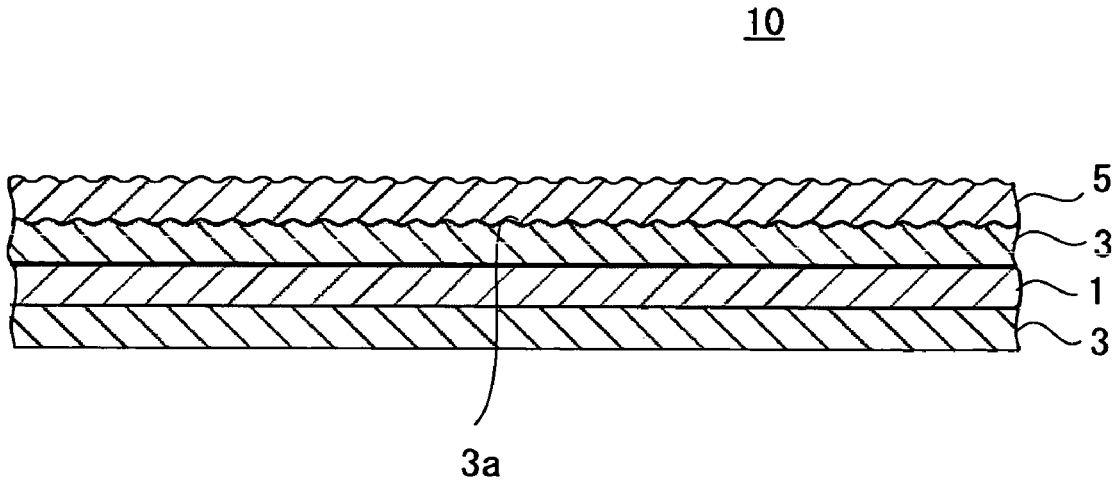
FIG. 1 is a schematic cross-sectional view showing an example of a sheet according to the present invention.

DESCRIPTION OF THE PREFERRED EMBODIMENTS (Surface Treatment Apparatus)

The surface treatment apparatus of the present invention comprises a sheet heating unit and a sheet cooling unit, may be at least one of conditions (1) to (4), and comprises other units if required.

Condition (1) is that the apparatus transfers a surface quality of the contact member to a surface of the image recording layer and an interface of the thermoplastic resin layer facing the image recording layer of the sheet;

condition (2) is that the apparatus further comprises the contact member selecting unit which selects the contact member having a desired surface quality from a plurality of contact members having different surface qualities;

condition (3) is that the apparatus further comprises a treatment control unit which controls treatment conditions of at least one of the sheet heating unit and the sheet cooling unit; and condition (4) is that the sheet heating unit includes a sheet preheating part which preheats the sheet and the apparatus transfers a surface quality of the contact member to the sheet heated by the sheet preheating part.

—Sheet Heating Unit—

The sheet heating unit is not particularly limited provided that it can heat the sheet to a temperature at which the image-recording layer and thermoplastic resin layer soften and are able to deform, and the surface quality of the contact member can be transferred to the image-recording layer surface and interface between the thermoplastic resin layer and image-recording layer of the sheet by applying pressure, but an example is the fixing apparatus in an electrophotographic apparatus known in the art, such as an apparatus comprising a pair of heat rollers (heat rollers and pressure rollers).

The sheet heating unit is not particularly limited provided that it comprises a sheet preheating part which preheats the sheet, and the surface quality of the contact member can be transferred to the sheet which is heated by the sheet preheating unit, and this may be suitably selected according to the purpose, for example a combination of a fixing unit and heating mechanism in an electrophotographic apparatus known in the art.

By providing the sheet preheating unit in the sheet heating unit, the heat amount required when the surface quality of the contact member is transferred to the sheet treatment surface can be reduced, and the sheet treatment surface can be brought to a softened state or melted state without fail by a relatively smaller heat amount. Further, after the surface quality of the contact member is transferred to the sheet, the surface quality of the sheet does not suffer elastic restoration, and the pressure force when the surface quality of the contact member is transferred to (formed on) the sheet can be made relatively small, which is advantageous.

The sheet preheating unit is not particularly limited provided that it can heat the sheet treatment surface to reach the softening state or melted state in which the surface quality of the contact member can be transferred, and may be suitably selected according to the purpose, but it preferably comprises an inner heat roller disposed on the inner side of an endless belt which suspends the endless belt so that it can rotate together with a rotation roller disposed on the inner side of the endless belt, and an outer heat roller disposed on the outer side of the endless belt which is gripped so that it can rotate the endless belt together with the inner heat roller. The number, construction and size of the sheet preheating unit are not particularly limited, and may be suitably selected according to the purpose.

The sheet preheating unit is not particularly limited provided that it heats the sheet in a state wherein the sheet treatment surface is brought into contact with the endless belt, e.g., (1) an aspect wherein plural rollers are combined, (2) an aspect wherein a roller is combined with the endless belt, (3) an aspect wherein it is disposed on the roller surface of the inner heat roller via the endless belt, and (4) an aspect wherein it is disposed on the rotating endless belt, further upstream than the inner heat roller and outer heat roller. Of these, the aspect (3) wherein it is disposed on the roller surface of the inner heat roller via the endless belt, and (4)

the aspect wherein it is disposed on the rotating endless belt, further upstream than the inner heat roller and outer heat roller, are preferred.

The aforesaid sheet preheating unit preferably comprises a transport unit which transports the sheet while it is in contact with the endless belt. This transport unit is preferred because the fact that it comprises a heating mechanism increases the heating efficiency of the sheet preheating unit. The heating mechanism is not particularly limited and may be suitably selected according to the purpose, for example a heater or heat roller or the like. The transport unit may conveniently comprise a contact belt which brings the sheet into contact with the endless belt, and rotation rollers on the inner side of this contact belt which suspend the contact belt so that it is free to rotate. If one of the aforesaid rotation rollers is an external heat roller, the construction of the apparatus can be simplified, and preheating in the sheet preheating part can be performed adequately without fail, which is therefore preferred.

The contact member is not particularly limited regarding shape, structure, size and material, and may be suitably selected according to the purpose, for example a sheet cut to a desired size, texture sheet, roller or an endless belt. The advantage of a cut sheet and texture sheet is that the surface quality can be modified for each cut sheet, whereas the advantages of an endless belt are that continuous treatment is easy and separation of the contact member and endless belt is easy.

The size, material and shape of the texture sheet are not particularly limited and may be suitably selected according to the purpose, e.g. in the case of forming a matt surface, a thin metal plate (e.g., thickness t=0.3 mm or less) may be used, and a uniform surface roughness or pattern formed over the whole surface. The surface roughness of the texture sheet is preferably from 20% to 100% or more of the desired roughness of the sheet.

If an endless belt is used as the aforesaid contact member, the endless belt preferably has a smooth surface. In this case, by suitably modifying the sheet surface treatment conditions, the sheet surface may be formed as a matt surface or gloss surface as desired.

If an endless belt is used as the aforesaid contact member, it is particularly preferred that the sheet heating unit comprises the endless belt and a pair of heat rollers disposed so that the endless belt is in pressure contact from its inner side and outer side.

The endless belt is not particularly limited, and may be suitably selected according to the purpose, but the belt used in a belt fixing apparatus of an electrophotographic apparatus known in the art can be used. The belt material is not particularly limited, and may be suitably selected from among those known in the art. The endless belt surface may be surface-treated by a silicone or fluorinated surface treatment agent in order to improve the separation ability of the sheet.

The pair of heat rollers are not particularly limited and may be suitably selected according to the purpose, e.g. they may be suitably selected from among heat roller pairs used in electrophotographic apparatuses known in the art, but it is preferred that the nip pressure and heating temperature, etc., are adjustable.

The material of the contact member is not particularly limited provided that it can impart a desired surface quality to the sheet and may be suitably selected according to the purpose, e.g., a material having heat resistance properties above the softening point temperature of the thermoplastic resin layer to which surface quality is imparted, such as a polyethylene terephthalate film, polyethylene film, polypropylene film, nylon film, polyimide film, polystyrene film and fluorinated olefin film.

The surface quality of the contact member is preferably one of a gloss surface, matt surface and embossed surface according to user requirements.

A gloss surface imparts smoothness and luster to the sheet surface which is subjected to heat and pressure between the nip rollers of a super calender or gloss calender having a smoothed surface, cooling and separation.

The aforesaid matt surface is obtained by performing roughness treatment (matt treatment) on a protrusion-shaped reflecting surface. Examples of the matt treatment methods are sandblasting, hot extrusion and plasma ion processing.

An effect substantially identical to this matt treatment can be obtained by providing a coating layer comprising a transparent bead coating layer.

The aforesaid embossing surface is obtained by embossing treatment. This is the forming of depressions and protrusions in a material by etching or by rolling using an embossing roller in which a depression-and-protrusion pattern is engraved.

The aforesaid embossing roller is a metal roller having a diameter of 100 to 500 mm wherein projections are engraved corresponding to the depressions in the surface. Depressions are formed in the material surface by rolling the material between a pair of rollers (elastic rollers with a flat surface). It is preferred that the rolling temperature is 80 to 200° C., the speed is 30 to 150 m/min. and the pressure is of the order of 1000 to 20000 kgf/m$^2$.

Embossing treatment is described for example in "The Surface Technology Manual (edited by Surface Finishing Society of Japan, published by Nikkan Kogyo Shimbun (1998))", and "The New Paper Coating Manual, (edited by Industrial Paper Times Co., published by Industrial Paper Times Co. (1980)".

Due to this pair of heat rollers, the aforesaid sheet and contact member pass superimposed on each other through the nip part formed between this pair of heat rollers in synchronism with the rotation of the pair of heat rollers while being heated. If pressure is applied to the nip part, the sheet and contact member pass through superimposed on each other while heat and pressure are applied to the nip part.

The heating temperature produced by the aforesaid sheet heating unit is not particularly limited and may be suitably selected according to the sheet type, but it is preferably equal to or higher than the softening point of the thermoplastic resin in the thermoplastic resin layer of the sheet. As an example, it is normally 80 to 120° C., but if the thermoplastic resin layer is a polyethylene resin layer, it is preferably 95 to 110° C.

The pressure produced by the sheet heating unit is preferably within a pressure range of 7 to 20 kgf/cm$^2$ in the nip part.

—Sheet Cooling Unit—

The sheet cooling unit is not particularly limited provided that it can cool the sheet treatment surface treated with heat and pressure by the sheet heating unit while it is in contact with the contact member, and may be suitably selected from among cooling apparatuses known in the art according to the purpose, but from the viewpoint of being able to adjust cooling conditions, it is preferably a unit which can blow air to adjust the cooling temperature. The number of sheet cooling unit is not particularly limited, and may be suitably selected according to the purpose.

The position in which the sheet cooling unit is provided is not particularly limited and may be suitably selected according to the purpose, but it is usually downstream from the sheet heating unit in the sheet transport direction. If the sheet heating unit comprises the pair of heat rollers and the endless belt described above, it is preferably provided between the pair of heat rollers and rotating rollers suspending the endless belt such that it is free to rotate together with the pair of heat rollers, and in the vicinity of the endless belt. In this case, the sheet is cooled by the sheet cooling unit between the pair of heat rollers and the rotating rollers.

The cooling temperature produced by the sheet cooling unit may be suitably selected according to the sheet type, and is not particularly limited provided that it is a temperature less than the softening point of the thermoplastic resin in the thermoplastic resin layer of the sheet, but it may be suitably selected according to the purpose and is preferably less than 80° C.

In the present invention, using one of a roller, endless belt and texture sheet as the contact member, the surface quality is preferably adjusted by modifying any of the pressure conditions, heating temperature and cooling temperature in the contact member. As a result, images having different surface qualities in sheet units, or images having different surface qualities within one sheet, can be formed. Moreover, plural rollers, belt and texture sheets having different surface roughnesses are unnecessary, and an apparatus to interchange them is also not required. It may also be noted that, as it is possible to modify any of the pressure conditions, heating temperature and cooling temperature in one sheet, a variation of surface quality may be given to one sheet so that visual effects are obtained due to gradation.

In this case, the method of modifying pressure conditions in the sheet heating unit is not particularly limited and may be suitably selected according to the purpose, for example a method which makes the spring length of nip springs at the two ends of the pressure rollers variable. The method of making the spring length variable may for example be a method due to the rotation of a cam, or a method which varies the position of a stopper by a mechanism.

The method of modifying the heating conditions in the sheet heating unit is not particularly limited and may be suitably selected according to the purpose, for example a method which makes the temperature of the heaters in the heat rollers variable. The method of making the temperature variable may be to dispose a temperature detecting apparatus on a roller surface outside the paper passage part, and control this to a desired temperature.

In practice, the surface quality of the sheet may conveniently be modified as shown in the following Table 1 and Table 2 using any of a roller, endless belt and texture sheet as the contact member.

TABLE 1

| Finish | Gloss treatment |
|---|---|
| Heating temperature parameter | Low ⟷ High |
| Sheet surface smoothness after surface treatment | x ⟷ ○ |
| Pressure parameter | Low ⟷ High |
| Sheet surface smoothness after surface treatment | x ⟷ ○ |
| Cooling temperature parameter | Low ⟷ High |
| Sheet surface smoothness after surface treatment | ○ ⟷ x |

TABLE 2

| Finish | Matt treatment |
|---|---|
| Heating temperature parameter | Low ⟷ High |
| Sheet surface unevenness after surface treatment | x ⟷ ○ |
| Pressure parameter | Low ⟷ High |
| Sheet surface unevenness after surface treatment | x ⟷ ○ |
| Cooling temperature parameter | Low ⟷ High |
| Sheet surface unevenness after surface treatment | ○ ⟷ x |

Note:
In Tables 1 and 2, "○" means good, and "x" means bad.

The following relations may be determined from Table 1 and Table 2.

In the case of gloss treatment (smoothing of surface), (1) the surface is smoother, the higher is the heating temperature, (2) the surface is smoother, the higher is the pressure, (3) the surface becomes rough when the temperature of the separation part is equal to or higher than the softening point temperature of the thermoplastic resin in the thermoplastic resin layer.

In the case of matt treatment (forming depressions and protrusions), (1) the depressions and protrusions are deeper, the higher is the heating temperature, (2) the depressions and protrusions are deeper, the higher is the pressure, and (3) the depressions and protrusions are shallower, when the temperature of the separation part is equal to or higher than the softening point temperature of the thermoplastic resin in the thermoplastic resin layer.

Hence, by controlling one of the heating temperature, pressure force and cooling temperature as a surface treatment condition parameter, images can be formed with different surface qualities in sheet units, or images can be formed with different surface qualities depending on the position of the image within one sheet, even when the same contact member is used.

For example, to treat an image surface using a contact member for gloss treatment whose surface has a high smoothness, it is possible to transfer the roughness (or smoothness) profile of the surface of the contact member which has a high smoothness quite faithfully to the image surface (including the interface between the image recording layer and the thermoplastic resin layer thereof) by setting the heating temperature to 110° C. and the pressure to 20 kgf/cm$^2$. By contrast, if the heating temperature is set to 95° C. and the pressure to 7 kgf/cm$^2$, the roughness (smoothenss) profile of the surface of the contact member having a high smoothness is transferred unfaithfully to the image surface and therefore an image with less gloss can be obtained. Further, by changing the setting values of the heating pressure from 95 to 110° C. and pressure from 7 to 20 kgf/cm$^2$, it is possible to control the degree of transfer, and thus the reproduction on the image surface, of the surface of the contact member. In addition, it is also possible to control the degree of transfer and reproduction of the surface of the contact member by changing the setting value of the cooling temperature within a range of from the softening point of the thermoplastic resin layer to a temperature about 5 to 30° C. lower than the softening point.

Herein, a method of forming images with different surface qualities according to the position of the image within one sheet is for example to adopt a construction wherein the heat roller and pressure roller (e.g., 21 and 24 of FIG. 8) are split in the sheet transport direction and perpendicular direction thereto, and a heat control unit (heater or temperature sensor) or nip pressure control unit is provided for each of the heat roller and pressure roller. As a method of varying the heating temperature in the sheet transport direction, it is rather difficult to track temperature but nip pressure control has a good response, so the surface quality can be made different even in the sheet transport direction.

—Contact Member Selecting Unit—

The surface treatment apparatus of the present invention preferably comprises a contact member selecting unit. This contact member selecting unit is not particularly limited and may be suitably selected according to the purpose, but examples are:

(1) plural contact members having different surface qualities are housed in a rack, and a unit selects the contact member having the desired surface quality from the rack, and (2) contact members (thermoplastic belts) having plural surface patterns with different surface qualities, and a position detecting sensor which can detect the position of these plural surface patterns, are provided, and the belt (contact member) having the desired surface quality is selectively superimposed on the sheet surface based on surface quality information obtained by the position detecting sensor.

In this case, contact member racks divided into different types are identified based on user information provided by a user information providing unit for providing user information including contact member surface quality data, the desired contact member is automatically selected, and sent to the sheet heating unit.

—User Information Providing Unit—

The surface treatment apparatus of the present invention preferably comprises user information providing unit. The user information providing unit is not particularly limited and may be suitably selected according to the purpose, for example manual input from the user, online input, Internet and portable terminals. The user information is not particularly limited and may be suitably selected according to the purpose, for example contact member surface quality (gloss surface, matt surface and embossed surface), number of sheets treated, paper size (A4, B4, A3, B5), etc.

—Treatment Control Unit—

The treatment control unit is not particularly limited provided that it can control treatment conditions in at least one of the sheet heating unit end sheet cooling unit according to the sheet type, and may be a computer or the like. For example, control systems used in image recording apparatuses known in the art may be suitably modified according to the purpose.

The aforesaid treatment control unit for example preferably comprises a magazine ID identification unit which identifies a magazine ID of a magazine housing the sheet, and a treatment conditions selecting unit which selects the treatment conditions corresponding to the magazine ID identified by the magazine ID identification unit. In this case, a relation may previously be established between the sheet type and magazine ID, and if a relation is established between this magazine ID and a treatment mode, a suitable treatment mode may automatically be assigned according to the sheet type (for each type), which is advantageous.

The aforesaid magazine in this case may be directly connected to the surface treatment apparatus of the present invention, and when the surface treatment apparatus is connected to or built into the image recording apparatus, it may be connected to the image recording apparatus.

The treatment control unit comprising this magazine ID identification unit and treatment conditions selecting unit may for example be connected via an interface. In this case, the treatment conditions selecting unit reads predetermined treatment conditions or treatment modes from a storage unit (e.g., ROM or HD) which stores treatment conditions or treatment modes, based on the magazine ID information identified by the magazine ID identification unit, and controls the driving of each unit in the surface treatment apparatus by a CPU or the like.

The treatment conditions selecting unit is not particularly limited and may be suitably selected according to the purpose, but it preferably has a function for selecting a desired treatment mode from among plural treatment modes specified by treatment conditions (control parameter files) for treating the sheet, and more preferably has a function for selecting a desired treatment mode from among the aforesaid plural treatment modes based on the magazine ID identified by the magazine ID identification unit. In this case, a suitable surface treatment can be performed according to the sheet type, which is preferred.

The sheet type is not particularly limited, but it preferably comprises at least a thermoplastic resin layer and may for example be suitably selected from among sheets (media) used in image recording methods known in the art. Specific examples are a thermosensitive recording sheet, an inkjet sheet, an electrophotographic sheet, a hot developing sheet, a silver halide photographic sheet, and a silver halide digital photographic sheet which are used in photographic prints, but those having the aforesaid thermoplastic resin layer on the surface are particularly preferred.

The treatment mode is not particularly limited and may be suitably selected according to the purpose, for example it may be set by at least one type of treatment condition. Preferably, for example, about three types of treatment mode can be set for each sheet type, or for each product type even if the sheet type is the same, so that the surface state obtained after treatment can respectively be adjusted to gloss or matt.

The treatment conditions are not particularly limited and may be suitably selected according to the purpose, for example the heating temperature, pressure force, heating time and pressure time in the sheet heating unit, or the cooling temperature and cooling time in the sheet cooling unit. More specifically, these include the temperature of the heat rollers on the inner side of the endless belt in the pair of heat rollers, the temperature of the heat rollers forming the nip part in contact with the endless belt, the pressure of the nip part, an air blower amount of a cooling fan in the cooling apparatus, the distance between the pair of heat rollers and the aforesaid rotation rollers, and the endless belt rotation speed (sheet transport speed).

In the present invention, the aforesaid treatment control unit for example preferably comprises an operation screen display unit which can display the treatment conditions on a screen so that they can be selected. In this case, the operator can freely select the gloss of the image obtained, which is advantageous.

The operation screen display unit is not particularly limited, and may for example be a monitor screen known in the art. The display screen produced by the operation screen display unit is not particularly limited and may be suitably selected according to the purpose, for example a screen which displays the degree of gloss after treatment so that it can be selected, including at least one of gloss and matt, and also displays the sheet type so that at least one can be selected from a thermosensitive recording sheet, inkjet sheet, electrophotographic sheet, hot developing sheet, silver halide photographic sheet and silver halide digital photographic sheet.

The treatment condition control by the aforesaid treatment control unit may be performed by suitably modifying the drive of the aforesaid sheet heating unit and sheet cooling unit. Specifically, for example, the heating temperature in the sheet heating unit can be controlled by increasing or decreasing the power of the pair of heat rollers, the heating time in the sheet heating unit can be controlled by increasing or decreasing the rotation speed of the pair of heat rollers, the cooling time in the sheet cooling unit can be controlled by increasing or decreasing the cold air blower amount by increasing or decreasing the power of the cooling apparatus, and the cooling time in the sheet cooling unit can be controlled by slowing the rotation speed of the endless belt, or by adjusting the distance from the pair of heat rollers to the rotation rollers in the endless belt.

—Sheet—

The sheet comprises at least the thermoplastic resin layer and image recording layer on a base, and if required, may further comprise a surface protection layer, interlayer, underlayer, cushion layer, charge regulating (preventing) layer, reflecting layer, color tone adjusting layer, storage properties improving layer, anti-adhesion layer, anti-curl layer and smoothing layer.

Figure 3:
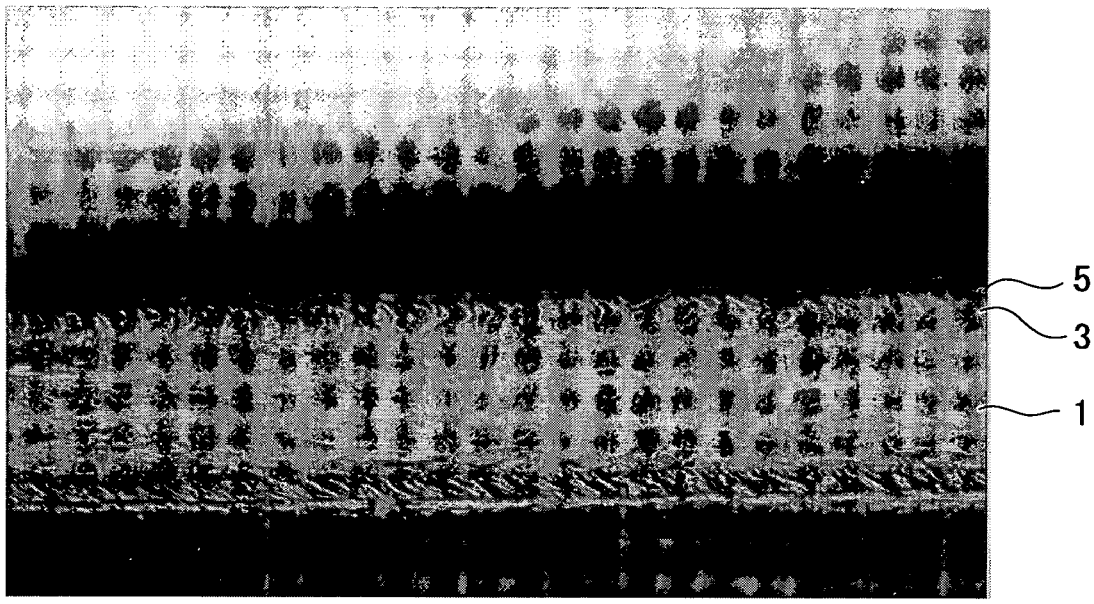
FIG. 3 is a cross-sectional photograph of a sheet after surface treatment.

As shown in FIG. 1, according to the surface treatment of the present invention, in the sheet 10, the surface quality of the contact member can be transferred not only to the surface of the image recording layer 5, but also to the interface 3*a* of the thermoplastic resin layer 3 with the image recording layer on the image recording layer side. This is observed in the cross-sectional photograph of FIG. 3 (magnification: 138 times), showing that in the cross-section of the sheet after surface treatment, the image recording layer 5 is also deformed following the deformation of the thermoplastic resin layer 3. This shows also that the surface quality is transferred not only to the image recording layer but also to the thermoplastic resin layer.

Figure 2:
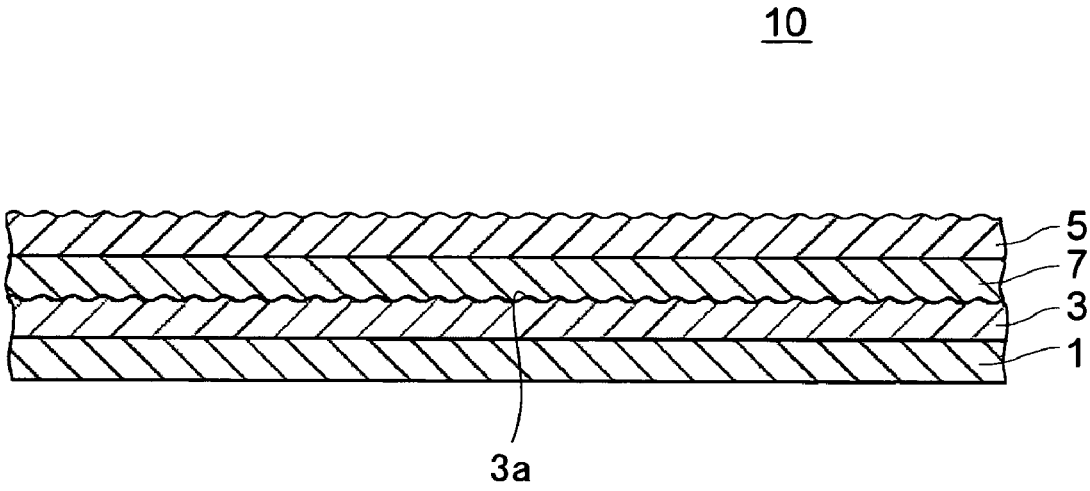
FIG. 2 is a schematic cross-sectional view showing an example of a sheet according to another aspect of the present invention.

Further, as shown in FIG. 2, when the sheet 10 comprises an interlayer 7 between the thermoplastic resin layer 3 and image recording layer 5, the surface quality of a content member can be transferred to the surface of the image recording layer 5, and the interface 3*a* between the thermoplastic resin layer 3 and interlayer 7.

—Base—

Examples of the base include synthetic paper (synthetic paper made from, for example, polyolefins or polystyrenes), woodfree paper, art paper, (double-sided) coated paper, (double-sided) cast coat paper, mixed paper made from polyethylene or another synthetic resin pulp and natural pulp; Yankee paper, baryta paper, wallpaper, backing paper, synthetic resin- or emulsion-impregnated paper, synthetic rubber latex-impregnated paper, paper comprising a synthetic resin as an internal additive, paperboard, cellulosic fiber paper, and other paper substrates; films and sheets of plastics or polymers such as polyolefins, poly(vinyl chloride), poly(ethylene terephthalate), poly(styrene methacrylate), poly(ethylene naphthalate), polycarbonate-poly(vinyl chloride), polystyrenes, polypropylenes, polyimides, celuloses such as triacetylcellulose; films and sheets obtained by subjecting these plastic films and sheets to a treatment, such as addition of a pigment such as titanium oxide for imparting white-reflecting properties; fabrics; metals, and glass.

Each of these bases can be used alone or in combination as a multilayer assemblage.

Examples of the base can also be found in JP-A No. 62-253159 (pp. 29-31 in Japanese), JP-A No. 01-61236 (pp. 14-17 in Japanese), JP-A No. 63-316848, JP-A No. 02-22651, JP-A No. 03-56955, and U.S. Pat. No. 5,001,033.

The thickness of the base is generally from 25 to 300 μm, preferably from 50 to 260 μm, and more preferably from 75 to 220 μm.

The stiffness (rigidity) of the base is not specifically limited, can be appropriately selected depending on an intended purpose and are preferably near to those in bases for use in color silver halide photography when the sheet is used as an image-receiving sheet of photographic quality.

The base may further comprise various additives appropriately selected according to the purpose within ranges not adversely affecting the advantages of the present invention.

Such additives include, but are not limited to, brightening agents (whitening agents), conductant agents, fillers, and pigments and dyes such as titanium dioxide, ultramarine blue, and carbon black.

The base may be subjected to any of surface treatments and/or primary coatings at one or both sides thereof to thereby improve adhesion with another layer such as a thermoplastic resin layer arranged thereon.

Such surface treatments include, for example, embossing or printing to form a glossy surface, a fine surface described in JP-A No. 55-26507, a matte surface or a tweed surface, corona discharge treatment, flame treatment, plasma treatment, and other activation treatments.

Each of these treatments can be employed alone or in any combination. For example, the base is subjected to the embossing and then to the activation treatment. It may be further subjected to the undercoating treatment after a surface treatment such as the activation treatment.

The base may be coated with a hydrophilic binder, a semiconductive metal oxide such as alumina sol or tin oxide, and an antistatic agent such as carbon black on its front side and/or back side. Typical disclosure of these coated bases can be found in, for example, substrates in JP-A No. 63-220246.

—Thermoplastic Resin Layer—

The thermoplastic resin forming the thermoplastic resin layer is not specifically limited, may be selected according to the purpose and includes, for example, polyolefins, poly(vinyl chloride)s, poly(ethylene terephthalate)s, polystyrenes, polymethacrylates, polycarbonates, polyimides, and triacetylcellulose, of which polyolefins are preferred. Each of these resins can be used alone or in combination.

Generally, a low-density polyethylene is used as the polyolefin. However, for improving the thermal resistance of the base, it is preferred to use a polypropylene, a blend of a polypropylene and a polyethylene, a high-density polyethylene, or a blend of the high-density polyethylene and a low-density polyethylene. From the viewpoint of cost and its suitableness for the lamination, it is preferred to use the blend of the high-density polyethylene and the low-density polyethylene.

The blend of the high-density polyethylene and the low-density polyethylene is used in a blend ratio (a mass ratio) of, for example, from 1:9 to 9:1, preferably from 2:8 to 8:2, and more preferably from 3:7 to 7:3. When the thermoplastic resin layer is applied to both sides of the base, the back side of the base is, for example, preferably the high-density polyethylene or a blend of the high-density polyethylene and the low-density polyethylene. The molecular weight of the polyethylenes is not particularly limited. Desirably, both of the high-density polyethylene and the low-density polyethylene have a melt index of 1.0 to 40 g/10-min. and a high extrudability.

The sheet or film to be laminated may be subjected to a treatment to impart white reflection thereto. For example, a pigment such as titanium dioxide is incorporated into the sheet or film.

—Image Recording Layer—

The image recording layer, in the case of silver halide photography, corresponds to an emulsion layer which generates the colors YMC, and in the present invention unit an emulsion layer prior to exposure and developing, or an emulsion layer after exposure and developing.

In the case of inkjet, it corresponds to an inkjet image-receiving layer which receives ink, and in the present invention unit an ink receiving layer prior to adhesion of ink or an ink receiving layer after adhesion of ink.

In the case of electrophotography, it corresponds to a toner image-receiving layer, and in the present invention unit a toner image-receiving layer prior to adhesion of toner or a toner image-receiving layer after adhesion of toner.

The image recording layer and thermoplastic resin layer may be identical.

The sheet is not particularly limited and may be suitably selected according to the purpose, for example an inkjet sheet, thermosensitive recording sheet, hot developing sheet, electrophotographic sheet or silver halide photographic sheet may be used. The sheet may be a sheet prior to image recording, or a sheet after image recording.

The aforesaid inkjet sheet may for example comprise a porous color material-receiving layer on a support, wherein the color material receiving layer receives a liquid ink such as an aqueous ink (using a dye or pigment as the color material) or an oil-based ink, or a solid ink which is solid at ordinary temperature and melt-liquefies for image printing, in order to form an image.

The aforesaid electrophotographic sheet may for example comprise at least a toner image-receiving layer on a support, wherein this toner image-receiving layer receives at least one of a color toner and black toner so as to form an image.

The aforesaid thermosensitive recording sheet may for example be a sheet disclosed in JP-A No. 06-130632, specifically a thermosensitive transfer sheet comprising at least a heat-melting ink layer as image recording layer on a support, used in a method wherein ink from the heat melting ink layer is melted by a thermosensitive head and melt-transferred to a thermosensitive transfer recording image-receiving sheet, a thermosensitive transfer sheet comprising at least an ink layer containing a heat-diffusing dye (e.g., sublimating dye) and a support used in a sublimation transfer method wherein the heat-diffusing dye from an ink layer is heated by a thermosensitive head and thereby transferred to a thermosensitive transfer recording image-receiving sheet, or a thermosensitive material used in the thermal autochrome method (TA method) wherein at least a heat coloring layer is provided on a support, and an image is formed by repeatedly heating by the thermosensitive head and fixing by ultraviolet light.

—Sheet Separation Unit—

The aforesaid sheet separation unit is not particularly limited and may be suitably selected according to the purpose, such as a method wherein a tension roller diameter is set small so that the sheet separates from the head under its own rigidity (strength). In the sheet separation unit, the contact member after the sheet has separated may be re-sent to the sheet heating unit via the content member selecting unit to be re-used.

—Other Units—

The other units are not particularly limited and may be suitably selected according to the purpose, for example a positioning unit or preheating unit, etc.

The positioning unit performs the positioning of the sheet and contact member. If this positioning unit is provided, surface treatment can be performed without any positional offset on the sheet surface to be treated, and as it offers excellent surface treatment efficiency and reliability, it is very advantageous.

The specific examples of the positioning unit are not particularly limited and may be suitably selected according to the purpose, but a sensor or the like is convenient. This sensor is not particularly limited, and may be a sensor which detects reflected light or reflected sound.

The preheating unit is a unit which preheats the sheet before it is heated by the sheet heating unit.

If this preheating unit is provided, the required heat amount when the sheet is heated by the sheet heating unit will be less, and different parts of the sheet treatment surface can be brought to the softening state or melting state without any risk of the heat being insufficient, which is an advantage. Also, as the preheating unit has a small thermal capacity and can heat the sheet while it is being transported, it is effective when a thermal head having a necessarily short heating time is used.

The specific examples of the preheating unit are not particularly limited and may be suitably selected according to the purpose, i.e., a heat roller, heater or a heating part of the image-forming apparatus (e.g., the drying part of a silver halide photography minilab, or the fixing part of an electrophotographic apparatus). In this case, the aforesaid heating part and surface treatment part must be brought sufficiently close together so that the temperature of the printed paper which has been heated in the drying part, does not fall too much.

In this case, if the apparatus is used for inkjet, an ink drying unit can be used as the preheating unit. This permits the apparatus to be made more compact and allows energy savings.

(Image Recording Apparatus)

The image recording apparatus of the present invention, in a first aspect, comprises a surface treatment unit and an image recording unit in this sequence, and may if required comprise other unit which are suitably selected.

The image recording apparatus according to this first aspect has a construction wherein the surface quality of the aforesaid contact member can be transferred by the surface treatment unit to the sheet prior to image recording.

The image recording apparatus according to this first aspect is suitable when an inkjet sheet is used as the sheet of the present invention.

The aforesaid inkjet sheet may for example comprise a porous color material-receiving layer on a support, wherein the color material-receiving layer receives a liquid ink such as an aqueous ink (using a dye or pigment as the color material) or an oil-based ink, or a solid ink which is solid at ordinary temperature and melt-liquefies for image printing, in order to form an image.

In this case, if an inkjet sheet comprising the porous ink-receiving layer containing a thermoplastic resin on the like is used as the sheet of the present invention, the porous structure of the inkjet sheet surface seals after image recording by inkjet, which prevents discoloration due to ozone.

The image recording apparatus of the present invention, in a second aspect, comprises an image recording unit and surface treatment unit in this sequence, and if required, other unit which are suitably selected.

The image recording apparatus according to this second aspect as a construction wherein the surface quality of the contact member can be transferred by the surface treatment unit to the sheet after image recording, and therefore surface treatment can be efficiently performed in succession after image recording.

The image recording apparatus according to this second aspect is suitable when one of a silver halide photographic sheet, hot developing sheet, thermosensitive recording sheet or electrophotographic sheet is used as the sheet of the present invention.

The aforesaid electrophotographic sheet may for example comprise at least a toner image-receiving layer on a support, wherein this toner image-receiving layer receives at least one of a color toner and black toner so as to form an image.

The aforesaid thermosensitive recording sheet may for example be a thermosensitive transfer sheet comprising at least a heat-melting ink layer as image recording layer on a support, used in a method wherein ink from the heat melting ink layer is melted by a thermosensitive head and melt-transferred to a thermosensitive transfer recording image-receiving sheet, a thermosensitive transfer sheet comprising at least an ink layer containing a heat diffusing dye (e.g., sublimating dye) and a support used in a sublimation transfer method wherein the heat-diffusing dye from an ink layer is heated by a thermosensitive head and thereby transferred to a thermosensitive transfer recording image-receiving sheet, or a thermosensitive material used in the thermal autochrome method (TA method) wherein at least a heat coloring layer is provided on a support, and an image is formed by repeating of heating by the thermosensitive head and fixing by ultraviolet light.

—Image Recording Unit—

The image recording unit is not particularly limited provided that it can form an image on the sheet, and may be suitably selected from image recording apparatuses known in the art which form images by image recording methods known in the art such as for example inkjet recording, thermosensitive recording, silver halide photography, heat developing/recording or electrophotography.

—Surface Treatment Unit—

The surface treatment unit is not particularly limited provided that it can perform surface treatment of the sheet on which the image is formed by the aforesaid image-forming unit, and may be selected as appropriate, but the surface treatment apparatus of the present invention described above is particularly suitable.

In the image recording apparatus, the surface treatment unit may be built into the image recording unit, or it may be provided externally to the image recording unit.

—Other Units—

There is no particular limitation on the other units which may be suitably selected according to the purpose, for example, a control unit or the like.

There is no particular limitation on the aforesaid control unit which may be any of those used in image-forming apparatuses known in the art, but it preferably can drive or stop driving the surface treatment unit so as to perform or not perform surface treatment of the sheet. The control unit is not provided independently, and a treatment control unit in the surface treatment apparatus may also provide the functions of this control unit.

If the control unit is provided, when the control unit stops driving the surface treatment unit, the image formed by the image recording unit can be ejected from the image recording apparatus without passing through the surface treatment unit (bypass route), and when it drives the surface treatment unit, the image formed by the image recording unit can be ejected from the image recording apparatus after passing through the surface treatment unit to perform surface treatment.

According to the image recording apparatus of the present invention, all or part of the surface of the image obtained may have any desired quality such as gloss, matt or embossed, for example plural surface glosses can be obtained even for the same image.

The present invention will now be described referring to specific embodiments, but it should be understood that the invention is not limited in any way thereby.

EXAMPLE 1

An example wherein the surface treatment apparatus of the present invention is used in an image recording apparatus for use with inkjet, will now be described.

Figure 4:
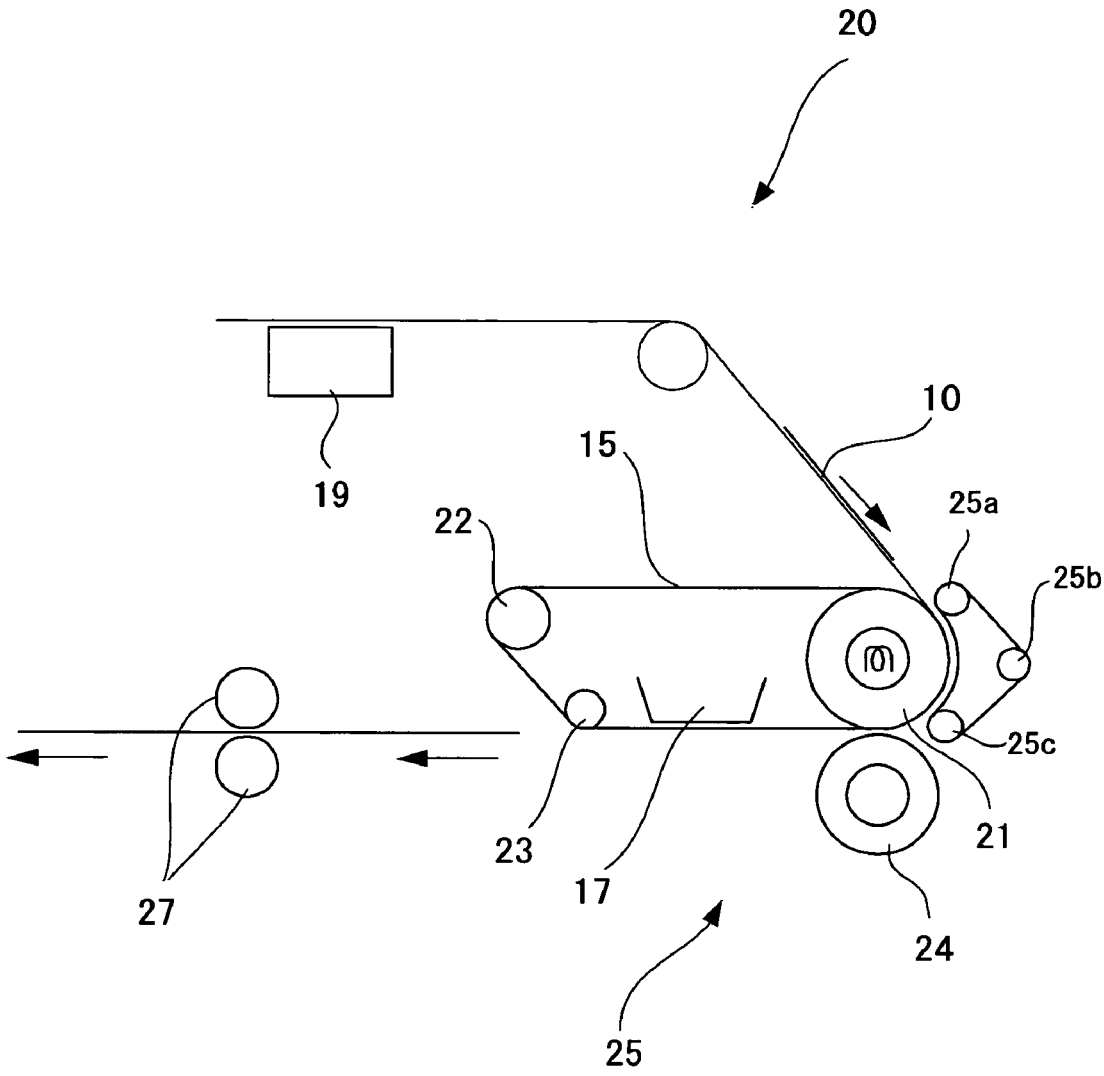
FIG. 4 is a schematic diagram showing an example of an image recording apparatus for inkjet comprising the surface treatment apparatus of the present invention.

FIG. 4 shows an example of an image recording apparatus 20 for use with inkjet. This image recording apparatus 20 is provided with a surface treatment apparatus 25 after an image recording unit, and performs surface treatment on a sheet 10 after image recording. The sheet 10 is an inkjet sheet shown in FIG. 1 wherein an image recording layer (ink-receiving layer) 5 is formed on a support coated with a polyethylene resin layer 3 on both sides of a base paper 1.

Although not shown, the image recording apparatus has a control unit such that, when surface treatment is not to be performed, the sheet avoids and does not pass through the surface treatment apparatus, or if a bypass is provided which does not pass through the surface treatment apparatus, the sheet passes through the bypass.

19 in FIG. 4 is an inkjet head which is an image recording part of the image recording apparatus, and when the sheet 10 is transported to the recording position, the inkjet head 19 operates and inkjet recording is performed. The sheet after inkjet recording is subjected to surface treatment, as described below.

The surface treatment apparatus 25 comprises an endless belt 15, heat roller 21, pressure roller 24, suspension roller 23, rotation roller 22 and cooling unit 17. The heat roller 21 and pressure roller 24 may be a pair of heat rollers.

The endless belt 15, suspension roller 23 and rotation roller 22 are disposed on the inner side of the endless belt 15, the endless belt 15 being suspended free to rotate by the heat roller 21, suspension roller 23 which is disposed at a position distant from the heat roller 21, and rotation roller 22.

The pressure roller 24 is disposed facing the heat roller 21 in contact with the endless belt 15. The gap between the pressure roller 20 and endless belt 15 is heated and placed under pressure by the pressure roller 24 and heat roller 21, forming a nip part. This endless belt 15 uses a material having a heat resistance temperature equal to or higher than the softening point of the thermoplastic resin in the thermoplastic resin layer of the sheet, and which is able to release the sheet.

The unit which superimposes the sheet 10 and endless belt (contact member) 15 is a substantially triangular endless belt 26 suspended by three pulleys 25*a*, 25*b* and 25*c*. The substantially triangular endless belt 26 is in contact with the endless belt 15 heated by the heat roller 21, and when the sheet 10 passes between the substantially triangular endless belt 26 and endless belt 15, the image recording surface of the sheet 10 and endless belt (contact member) are superimposed so that the surface quality of the endless belt 15 is transferred to the sheet 10.

The surface treatment apparatus of this Example 1 uses an endless belt with a smooth surface quality in order to perform gloss treatment. An endless belt with different surface quality can be used to perform matt treatment and embossed treatment.

The sheet 10 attached to (superimposed on) the endless belt is subjected to heat and pressure by the heat roller 21 and pressure roller 24, and the surface quality of the belt is thereby transferred. In this Example 1, the heat and pressure treatment is preferably performed at 80 to 120° C. which is the temperature at which the thermoplastic resin contained in the sheet softens and becomes deformable. The pressure is preferably 7 to 20 kgf/cm$^2$, but more preferably 10 to 15 kgf/cm$^2$. The endless belt 15 is disposed so as to come into contact with both sides of the image recording layer 5 of the sheet 10.

The aforesaid cooling unit 17 is not particularly limited provided that it can cool and solidify the sheet which has been subjected to heat and pressure, to a temperature less than the softening point of the thermoplastic resin in the thermoplastic resin layer while it is still adhering to the endless belt, and cooling apparatuses known in the art may be used. In this Example 1, a cooling apparatus which blows cold air is used, and cools to below 80° C. which is the softening point of the thermoplastic resin.

The separation unit is formed so that the cooled, solidified sheet separates from the belt under its own rigidity (strength) while it is moving on the endless belt 15, so the diameter of the suspension roller 23 is preferably set small.

In this surface treatment apparatus 25, firstly, when operation begins, the sheet 10 to be treated is transported and moved from an eject tray, not shown, in the image recording apparatus 20 to the interior of the surface treatment apparatus. It then enters the nip part formed between the heat roller 21 and pressure roller 24. The transport of the sheet up to this point can be performed by a transport roller or transport belt, and according to this example, the design is such that it is performed by a transport roller. The sheet 10 which has entered the nip part comes in contact with the surface of the endless belt 15 which rotates in synchronism with the rotation of the heat roller 21 and pressure roller 24. The rotation roller 22 and suspension roller 23 may rotate in synchronism with the rotation of the endless belt 15, or may be designed so that they are rotation driven to rotate the endless belt 15 together with the heat roller 21 and pressure roller 24. According to this embodiment, the rotation roller 22 and suspension roller 23 have the former design.

At this time, due to the heat roller 21 and pressure roller 24, as shown in FIG. 1, the thermoplastic resin layer 3 of the sheet 10 (in this example, the sheet is an electrophotographic image-receiving sheet, and the thermoplastic resin layer corresponds to a layer (polyethylene resin layer) provided on both sides of a support and an image-receiving layer provided on this layer) is heated to a temperature at which it can soften, and the sheet 10 inserted in the nip part is heated to a temperature at which the thermoplastic resin layer 3 in the nip part softens and becomes deformable. The thermoplastic resin layer 3 in the nip therefore softens, and can deform. At this time, the nip part is subjected to a pressure by the pressure force of the heat roller 21, so the sheet 10 is pressed on both surfaces when it passes through the nip part. When this occurs, the thermoplastic resin layer 3 in the sheet 10 which is in its softest state deforms while under pressure from the heat roller 21 and pressure roller 24, and both surfaces of the sheet 10 are smoothed. At this time, due to the pressure of the nip part, the sheet 10 passes through the nip part and is transported while still in intimate contact with the surface of the endless belt 15.

Next, the sheet 10 is cooled by the cooling apparatus 17 while in intimate contact with the surface of the endless belt 15, and the thermoplastic resin layer 3 thereon solidifies. It is thereby transported up to the rotation roller 22. At the rotation roller 22, as the transport direction of the endless belt 15 changes by 90° or more, the sheet 10 is separated from the surface of the endless belt 15 whereof the transport direction has abruptly changed. The sheet 10 which has separated from the endless belt 15 is than transported in the transport direction by a transport roller, not shown, and ejected to the eject tray, not shown. The surface quality of the endless belt 15 (contact member) is thereby transferred to the interface of the thermoplastic resin layer and surface of the image recording layer of the sheet 10 thus obtained, which becomes a mirror surface with high gloss.

EXAMPLE 2

An example where the surface treatment apparatus of the present invention is used in an image recording apparatus for hot developing will now be described.

Figure 5:
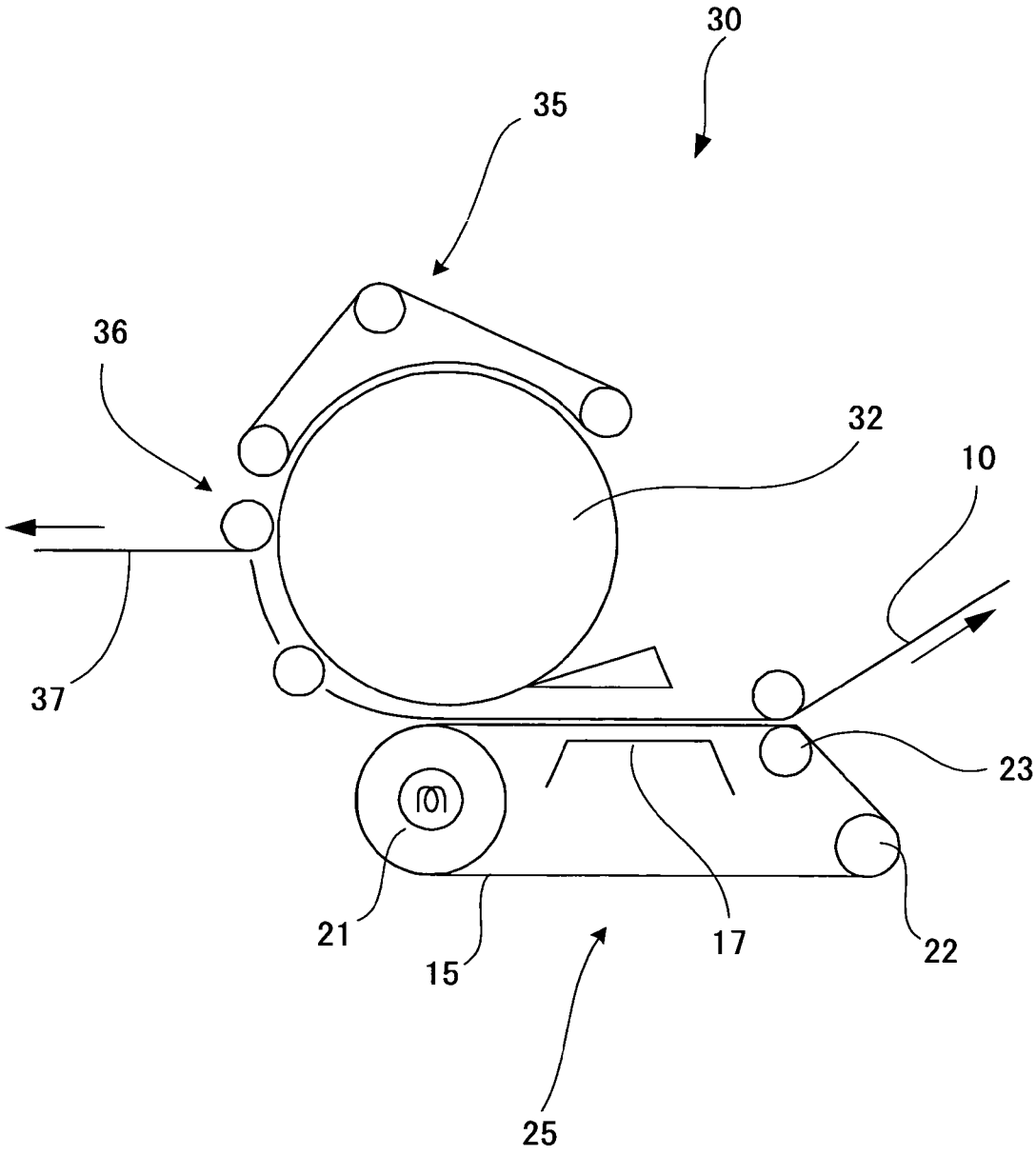
FIG. 5 is a schematic diagram showing an example of an image recording apparatus for hot developing comprising the surface treatment apparatus of the present invention.

FIG. 5 is an example of an image recording apparatus for hot developing.

This image recording apparatus 30 is provided with a surface treatment apparatus 25 after an image recording unit, and performs surface treatment on a sheet after image recording. The sheet 10 is a hot developing sheet shown in FIG. 1 wherein an image recording layer 5 is formed on a support coated with a polyethylene resin layer 3 on both sides of a base paper 1.

Although not shown, the image recording apparatus has a control unit such that, when surface treatment is not to be performed, the sheet avoids and does not pass through the surface treatment apparatus, or if a bypass is provided which does not pass through the surface treatment apparatus, the sheet passes through the bypass.

In an image recording apparatus 30 for hot developing of Example 2 shown in FIG. 5, image recording is performed in a recording part 35 prior to surface treatment. Specifically, a donor 37 is simultaneously exposed to the three colors CMY by a semiconductor laser, not shown, the exposed donor 37 is humidified by a small amount of water, developing is performed by superimposing the sheet 10 and applying heat/pressure by a developing drum 32, and an image is transferred by hot developing from the donor 37 to the sheet 10.

Subsequently, the sheet 10 is separated from the donor 37 by a separating part 36, the used donor is transported to a special tray, and surface treatment is performed on the sheet 10 whereupon the image has been recorded.

The surface treatment apparatus 25 has an identical construction to the image recording apparatus of the aforesaid Example 1, identical reference symbols being assigned to identical parts and their description is omitted, but in this Example 2, the developing drum 32 has the function of a pressure roller. The heat and pressure treatment is preferably performed at 80 to 120° C. which is the temperature at which the thermoplastic resin contained in the sheet softens and becomes deformable, and the pressure is preferably of the order of 7 to 20 kgf/cm$^2$. In the surface treatment apparatus of this Example 2, an endless belt with a smooth surface quality is used to perform gloss treatment. An endless belt with different surface quality can be used to perform matt treatment and embossed treatment.

In the image recording apparatus for hot developing in this Example 2, after hot developing transfer is performed by applying heat and pressure with the developing drum 32, heating is performed by the heat roller 21 of the surface treatment apparatus, so the preheating of hot developing transfer can be used, there is little energy wastage, and surface treatment can be performed efficiently.

EXAMPLE 3

An example where the surface treatment apparatus of the present invention is used in an image recording apparatus for silver halide photography will now be described.

Figure 6:
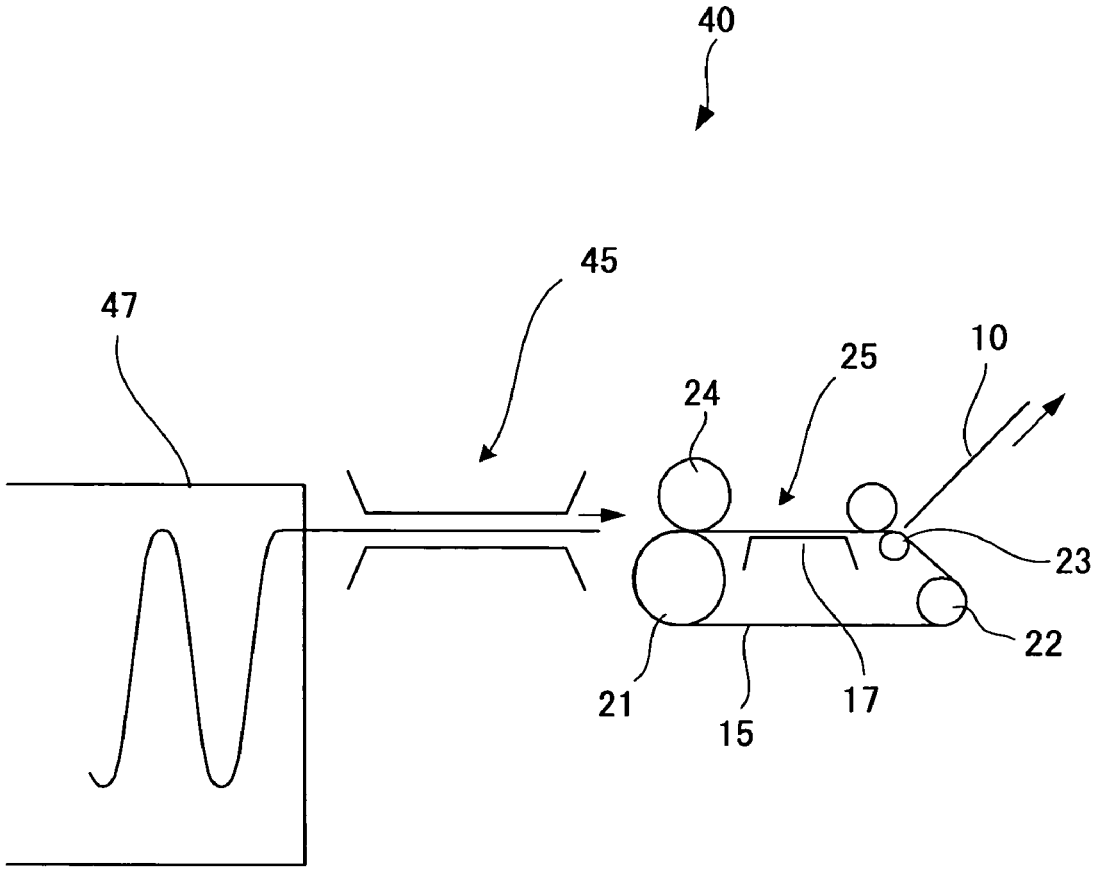
FIG. 6 is a schematic diagram showing an example of an image recording apparatus for silver halide photography comprising the surface treatment apparatus of the present invention.

FIG. 6 shows an example of an image recording apparatus for silver halide photography. This image recording apparatus 40 is provided with a surface treatment apparatus 25 after an image recording unit, and performs surface treatment on a sheet after image recording. The sheet 10 is a silver halide photography sheet shown in FIG. 1 wherein an image recording layer 5 is formed on a support coated with a polyethylene resin layer 3 on both sides of a base paper 1.

Although not shown, the image recording apparatus has a control unit such that, when surface treatment is not to be performed, the sheet avoids and does not pass through the surface treatment apparatus, or if a bypass is provided which does not pass through the surface treatment apparatus, the sheet passes through the bypass.

In an image recording apparatus 40 for silver halide photography of Example 3 shown in FIG. 6, the sheet 10 for silver halide photography which has been bake-exposed prior to surface treatment is passed through and wetted by plural treatment tanks 47, color developing, bleaching/fixing and water rinsing are performed, and after drying in a drying part 45, surface treatment is then performed by the surface treatment apparatus 25. The drying temperature in this drying part 45 is normally 60 to 80° C.

The surface treatment apparatus 25 which performs surface treatment has an identical construction to that of the surface treatment apparatus in the image recording apparatus of Example 1, identical reference symbols are assigned to identical parts and their description is omitted, but the heat and pressure treatment in Example 3 is preferably 80 to 120° C. which is the temperature at which the thermoplastic resin contained in the sheet softens and becomes deformable, and the pressure is preferably of the order of 7 to 20 kgf/cm$^2$. In the surface treatment apparatus of this Example 3, an endless belt with a smooth surface quality is used to perform gloss treatment. An endless belt with different surface quality can be used to perform matt treatment and embossed treatment.

In the image recording apparatus for silver halide photography of Example 3, after drying in the drying part 45, heating is performed by the heat roller 21 of the surface treatment apparatus, so the preheating of hot developing transfer can be used, energy wastage is small and surface treatment can be performed efficiently.

EXAMPLE 4

An example where the surface treatment apparatus of the present invention is used in an image recording apparatus for electrophotography will now be described.

Figure 7:
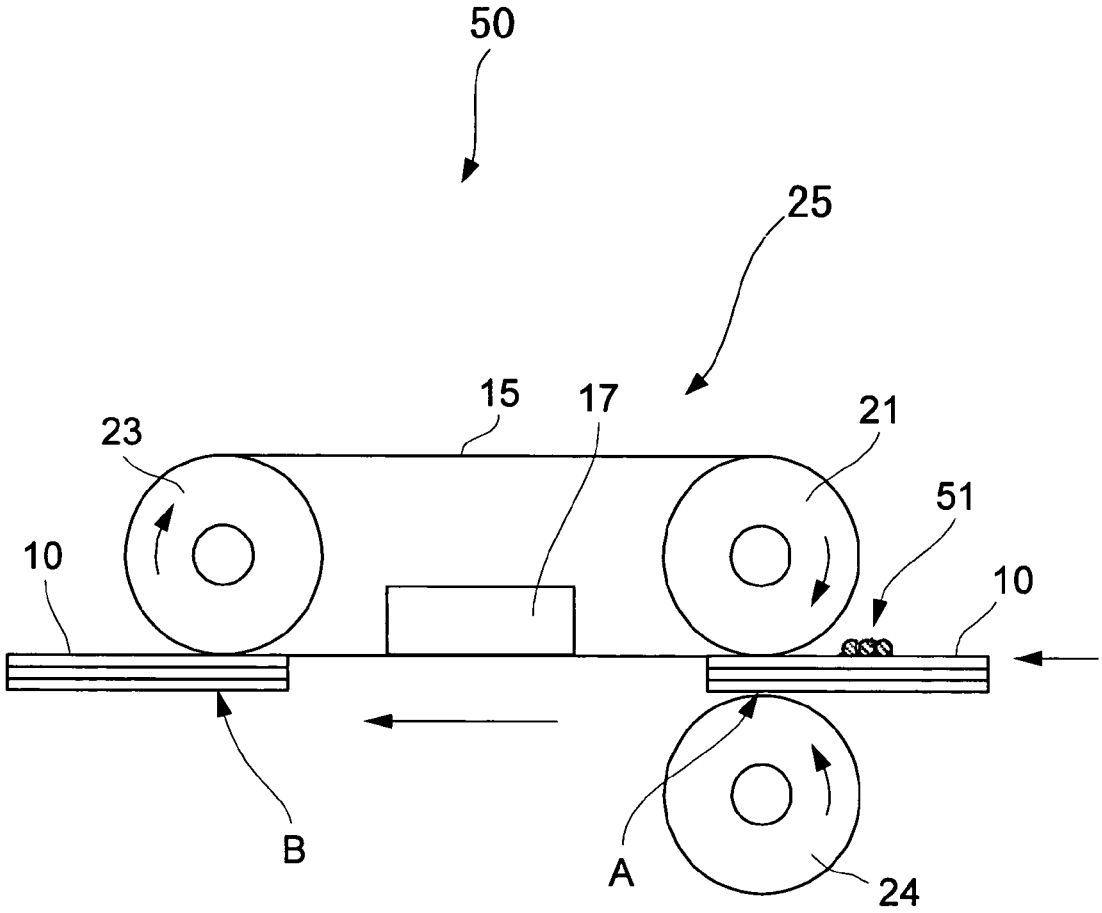
FIG. 7 is a schematic diagram showing an example of an image recording apparatus for electrophotography comprising the surface treatment apparatus of the present invention.

FIG. 7 shows an example of an image recording apparatus 50 for electrophotography. This image recording apparatus 50 is provided with a surface treatment apparatus 25 after an image recording unit, and performs surface treatment on a sheet after image recording. The sheet 10 is an electrophotographic sheet shown in FIG. 1 wherein an image recording layer (toner image-receiving layer) 5 is formed on a support coated with a polyethylene resin layer 3 on both sides of a base paper 1.

In the surface treatment apparatus of this Example 4, an endless belt with a smooth surface quality is used to perform gloss treatment. An endless belt with different surface quality can be used to perform matt treatment and embossed treatment.

In the surface treatment apparatus 25, a toner 51 is transferred to an electrophotographic sheet 10 by an image recording unit, not shown. The electrophotographic sheet 10 to which the toner 51 has adhered, is transported to a point A by a transport apparatus, not shown, passes between the heat roller 21 and pressure roller 24 (nip part), and is subjected to heat and pressure at a temperature (fixing temperature) at which the thermoplastic resin contained in the electrophotographic sheet 10 softens and becomes deformable. The heat roller 21 and pressure roller 24 may also be a pair of heat rollers.

Herein, the fixing temperature means the temperature of the toner image-receiving layer surface measured at the position of the nip part between the heat roller 21 and pressure roller 24 at the point A, for example less than 80 to 110° C. The pressure means the pressure of a toner image-receiving layer surface measured at the nip part between the heat roller 21 and pressure roller 24, and for example the pressure is preferably 1 to 10 kgf/cm$^2$ but more preferably 2 to 7 kgf/cm$^2$.

The electrophotographic sheet 10, after being subjected to heat and pressure in this way, is transported to the cooling apparatus 17 by the endless belt 15, and is cooled to a temperature less than the softening point of for example at least one of the polymer in the toner image-receiving layer and the binder resin used in the toner, or less than the glass transition temperature, i.e., preferably 20 to 80° C., but more preferably room temperature (25° C.).

The cooled electrophotographic sheet 10 is further transported to a point B by the endless belt 15, and the electrophotographic sheet 10 separates from the endless belt 15. In this case, the diameter of the tension roller 23 is set small so that the electrophotographic sheet 10 separates from the belt under its own rigidity (strength).

In this surface treatment apparatus, firstly, when operation begins, the sheet 10 to be treated is transported and moved from an eject tray in the image recording apparatus to the interior of the surface treatment apparatus. It then enters the nip part formed between the heat roller 21 and pressure roller 24. The transport of the sheet up to this point can be performed by a transport roller or transport belt, and according to this example, the design is such that it is performed by a transport roller. The sheet 10 which has entered the nip part comes in contact with the surface of the endless belt 15 which rotates in synchronism with the rotation of the heat roller 21 and pressure roller 24.

At this time, due to the heat roller 21 and pressure roller 24, as shown in FIG. 1, the thermoplastic resin layer of the sheet 10 (in this example, the sheet is an electrophotographic image-receiving sheet, and the thermoplastic resin layer corresponds to a layer (polyethylene resin layer) provided on both sides of a support and an image-receiving layer provided on this layer) is heated to a temperature at which it can soften, and the sheet 10 inserted in the nip part is heated to a temperature at which the thermoplastic resin layer in the nip part softens and becomes deformable. The thermoplastic resin layer in the nip therefore softens, and can deform. At this time, the nip part is subjected to a pressure by the pressure force of the heat roller 21, so the sheet 10 is pressed on both surfaces when it passes through the nip part. When this occurs, the thermoplastic resin layer in the sheet 10 which is in its softest state deforms while under pressure from the heat roller 21 and pressure roller 24, and both surfaces of the sheet 10 are smoothed. At this time, due to the pressure of the nip part, the sheet 10 passes through the nip part and is transported while still in intimate contact with the surface of the endless belt 15.

Next, the sheet 10 is cooled by the cooling apparatus 17 while in intimate contact with the surface of the endless belt 15, and the thermoplastic resin layer thereon solidifies. It is thereby transported up to the tension roller 23. At the tension roller 23, as the transport direction A of the endless belt 15 changes by 90° or more, the sheet 10 is separated from the surface of the endless belt 15 whereof the transport direction has abruptly changed. The sheet 10 which has separated from the endless belt 15 is than transported in the transport direction by a transport roller, not shown, and ejected to the eject tray, not shown. The surface quality of the endless belt 15 (contact member) is thereby transferred to the interface of the thermoplastic resin layer and surface of the image recording layer of the sheet 10 thus obtained, which becomes a mirror surface with high gloss.

EXAMPLE 5

Figure 8:
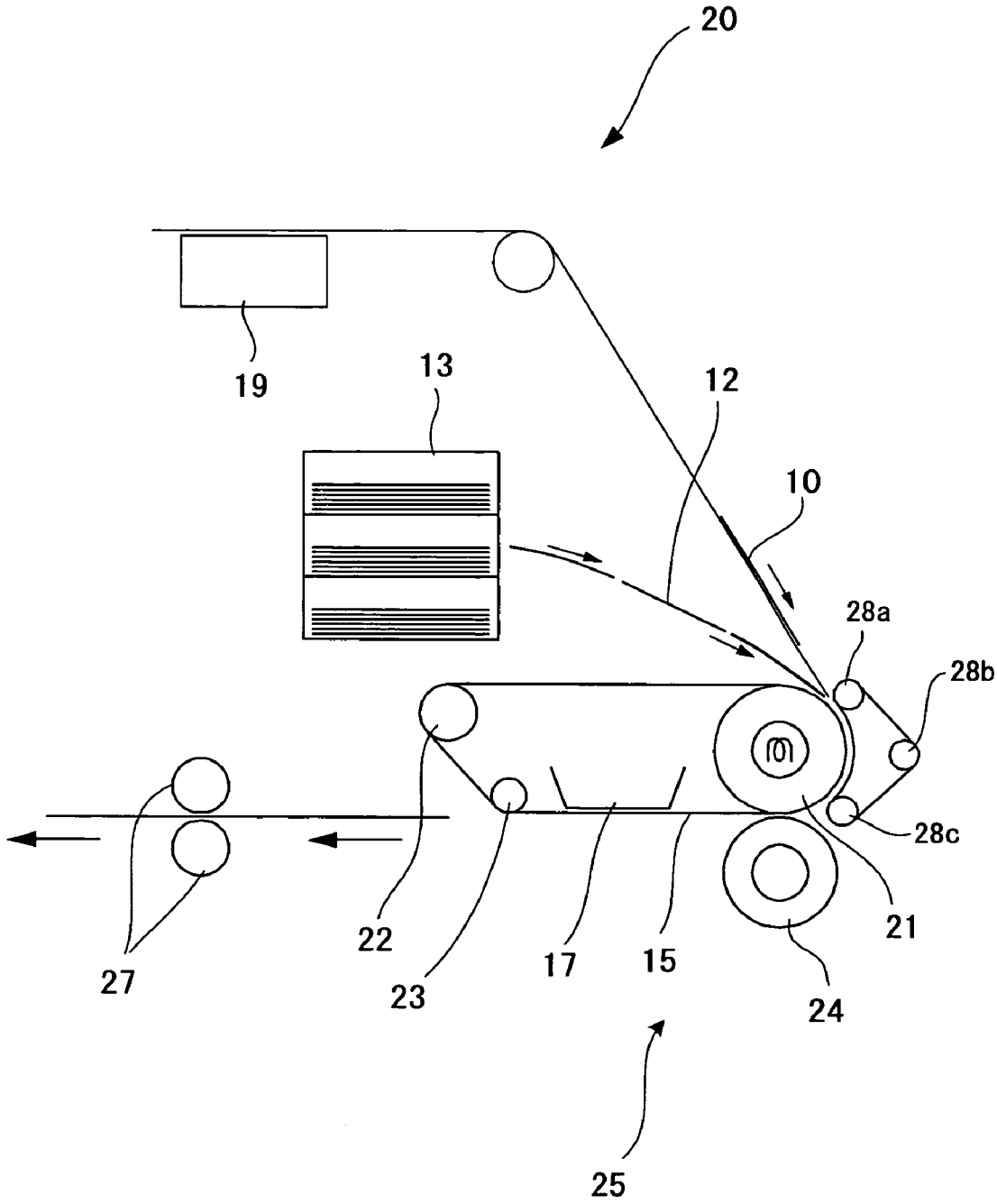
FIG. 8 is a schematic diagram showing an example of an image recording apparatus for inkjet comprising the surface treatment apparatus of the present invention.

FIG. 8 shows an example where the surface treatment apparatus of the present invention is used in an inkjet image recording apparatus. This inkjet image recording apparatus 20 comprises a surface treatment apparatus 25 disposed after the image recording unit, which performs surface treatment on the sheet 10 after image recording.

The sheet 10 is an inkjet sheet shown in FIG. 1 wherein an image recording layer (ink-receiving layer) 5 is formed on a support coated with a polyethylene resin layer 3 on both sides of a base paper 1.

19 in FIG. 8 is an inkjet head forming the image recording part of the image recording apparatus, and when the surface treated sheet is transported to the recording position, the inkjet head 19 operates to perform inkjet recording at this position.

Although not shown, the image recording apparatus has a control unit such that, when surface treatment is not to be performed, the sheet avoids and does not pass through the surface treatment apparatus, or if a bypass is provided which does not pass through the surface treatment apparatus, the sheet passes through the bypass.

Figure 9:
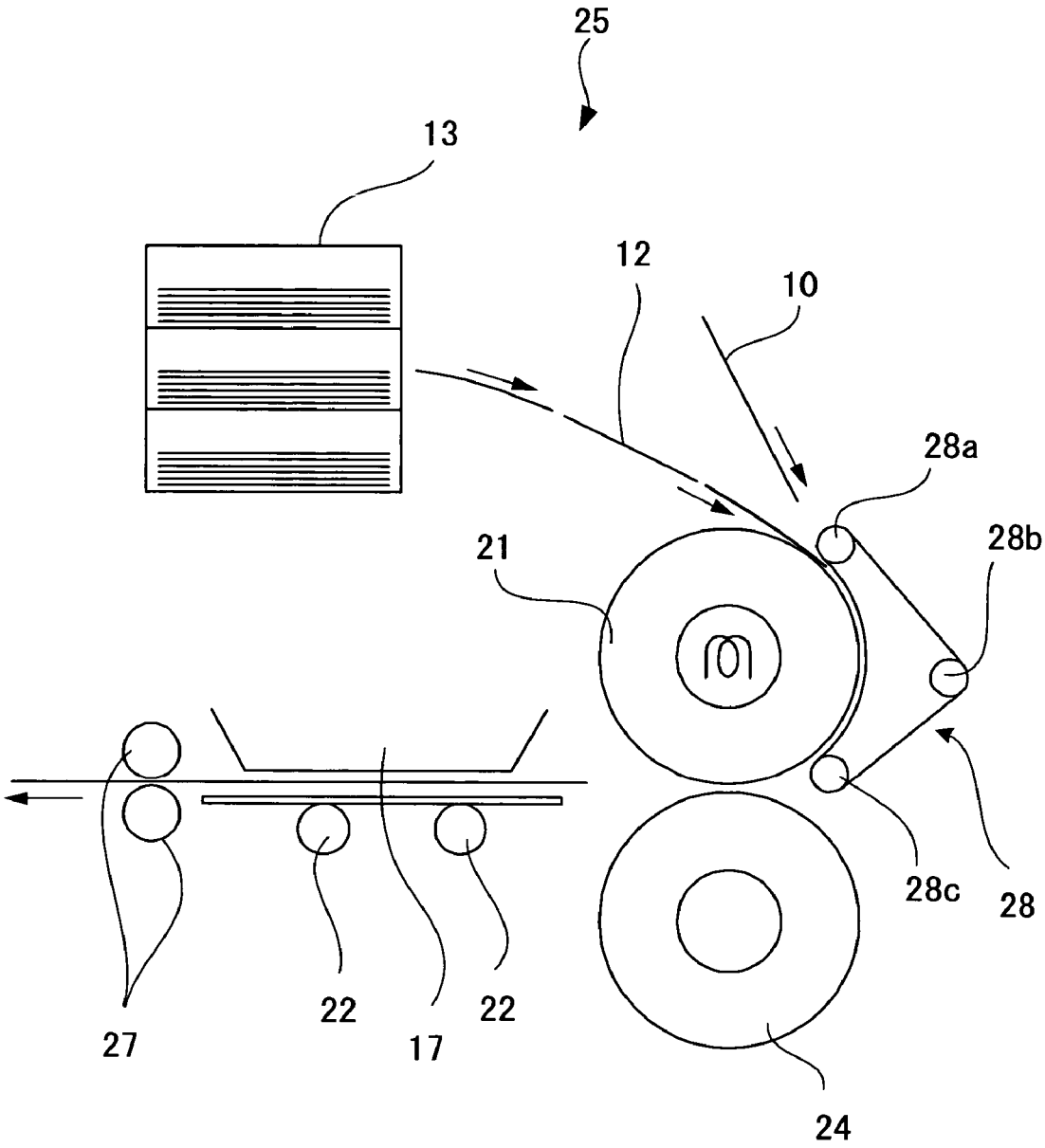
FIG. 9 is an enlargement of the surface treatment apparatus used in the image recording apparatus for inkjet according to the present invention shown in FIG. 8.

In Example 5, as shown in FIG. 9, the surface treatment apparatus 25 comprises the contact member selecting unit 13 and a sheet heating unit comprising the heat roller 21 and pressure roller 24, the cooling unit 17, the pair of transport rollers 27 and the rotation roller 22. The heat roller 21 and pressure roller 24 may be replaced by a pair of heat rollers.

The surface treatment apparatus 25 perform surface treatment on the sheet 10 after image recording. The sheet 10 is an inkjet sheet shown in FIG. 1 wherein an image recording layer (ink-receiving layer) 5 is formed on a support coated with a polyethylene resin layer 3 on both sides of a base paper 1.

As shown in FIG. 8, the contact member selecting unit 13 is disposed so that sheet-type contact members (texture sheets) 12 having different surface qualities are arranged in racks. In this surface treatment apparatus 25, three types of contact members (texture sheets) whereupon three surface qualities, i.e., gloss surface, matt surface and embossed surface are formed, are classified and arranged, so that the surface quality of the contact member can be selected based on user information from the user information processing unit, not shown.

Alternatively, as shown in FIG. 9, four surface qualities (e.g., quality A (gloss), quality B (matt), quality C (embossed) and quality D (other) are previously provided on a belt (contact member), and the contact member selecting unit 13 detects the surface quality information on the belt by a position detecting sensor, not shown, and selects a desired surface quality part of the belt based on this surface quality information and superimposes it on the sheet 10.

As the unit for superimposing and the sheet on the contact member (texture sheet), a substantially triangular endless belt 28 suspended between three pulleys 28*a*, 28*b* and 28*c* may for example be used. The substantially triangular endless belt 28 is in contact with the heat roller 21, and when the sheet 10 passes between the substantially triangular endless belt 28 and heat roller 21, the image recording surface of the sheet 10 is superimposed on the contact member 12, and the surface quality of the contact member 12 is transferred to the thermoplastic resin layer and image recording layer of the sheet 10.

The sheet stretched (superimposed on) the contact member is subjected to heat and pressure by the heat roller 21 and pressure roller 24, so the surface quality of the contact member is transferred to the sheet. In this surface treatment apparatus 25, the heat and pressure treatment is preferably performed at 80 to 110° C. which is the temperature at which the thermoplastic resin contained in the sheet softens and becomes deformable, and at a pressure of the order of 7 to 20 kgf/cm$^2$.

The cooling unit 17 is not particularly limited provided that it can cool and solidify the sheet which has been subjected to heat and pressure and the contact member, and any cooling apparatus known in the art may be used. In this surface treatment apparatus, a cooling apparatus which blows cold air is used, and it cools to below the softening temperature, more specifically approximately 70° C.

The separating unit is not shown in the diagram, but a method is used wherein a tension roller diameter is set small so that the sheet separates from the belt under its own rigidity (strength). Herein, the released contact member can be re-used by sending it again to the sheet heating unit by the contact member selecting unit.

In the surface treatment apparatus of FIG. 8, the contact member 12 and sheet 10 are configured to be transported by the action of the rotation roller 22 and transport roller 27, but in addition to this method, the contact member and sheet may also of course be mounted on the endless belt and thereby transported.

The belt material of the endless belt is not particularly limited, but an endless belt wherein for example polyimide, cast nickel and aluminum are formed as a base material, is suitable.

At least one type of thin film selected from among silicone rubber, fluorinated rubber, silicone resin and fluorinated resin is preferably formed on the belt material surface. Of these, an aspect wherein a fluorocarbon siloxane rubber layer is provided on a fixing belt surface, or an aspect wherein a silicone rubber layer is provided on the belt material surface and a fluorocarbon siloxane rubber layer is provided on this silicone rubber layer, is preferred.

In this surface treatment apparatus, firstly, when operation begins, the sheet 10 to be treated is transported and moved from an eject tray in the image recording apparatus to the interior of the surface treatment apparatus. Thus, the contact member (texture sheet) 12 selected by the contact member selecting unit 13 according to user specifications is inserted into the nip part formed between the heat roller 21 and pressure roller 24 so that it comes in contact with the sheet treatment surface. The transport of the sheet up to this point can be performed by a transport roller or transport belt, and according to this example, the design is such that it is performed by a transport roller.

At this time, due to the heat roller 21 and pressure roller 24, as shown in FIG. 1, the thermoplastic resin layer of the sheet 10 (in this example, the sheet is an electrophotographic image-receiving sheet, and the thermoplastic resin layer corresponds to a layer (polyethylene resin layer) provided on both sides of a support and an image-receiving layer provided on this layer) is heated to a temperature at which it can soften, and the sheet 10 and the contact member 12 inserted in the nip part is heated to a temperature at which the thermoplastic resin layer in the nip part softens and becomes deformable. The thermoplastic resin layer in the nip therefore softens, and can deform. At this time, the nip part is subjected to a pressure by the pressure force of the heat roller 21, so the sheet 10 is pressed on both surfaces when it passes through the nip part. When this occurs, the thermoplastic resin layer in the sheet 10 which is in its softest state deforms while under pressure from the heat roller 21 and pressure roller 24, and both surfaces of the sheet 10 are smoothed. At this time, due to the pressure of the nip part, the sheet 10 passes through the nip part and is transported while still in intimate contact with the surface of the contact member (texture sheet) 12.

Next, the sheet 10 and the contact member 12 are cooled by the cooling apparatus 17, and the thermoplastic resin layer thereon solidifies. The surface quality of the contact member (texture sheet) 12 is thereby transferred to the interface of the thermoplastic resin layer and surface of the image recording layer of the sheet 10 thus obtained, which becomes a mirror surface with high gloss.

In the above manner, a sheet to which the surface quality of the contact member desired by the user has been transferred, is obtained.

EXAMPLE 6

An example will now be described where the surface treatment apparatus of the present invention is used in an image recording apparatus for hot developing.

Figure 10:
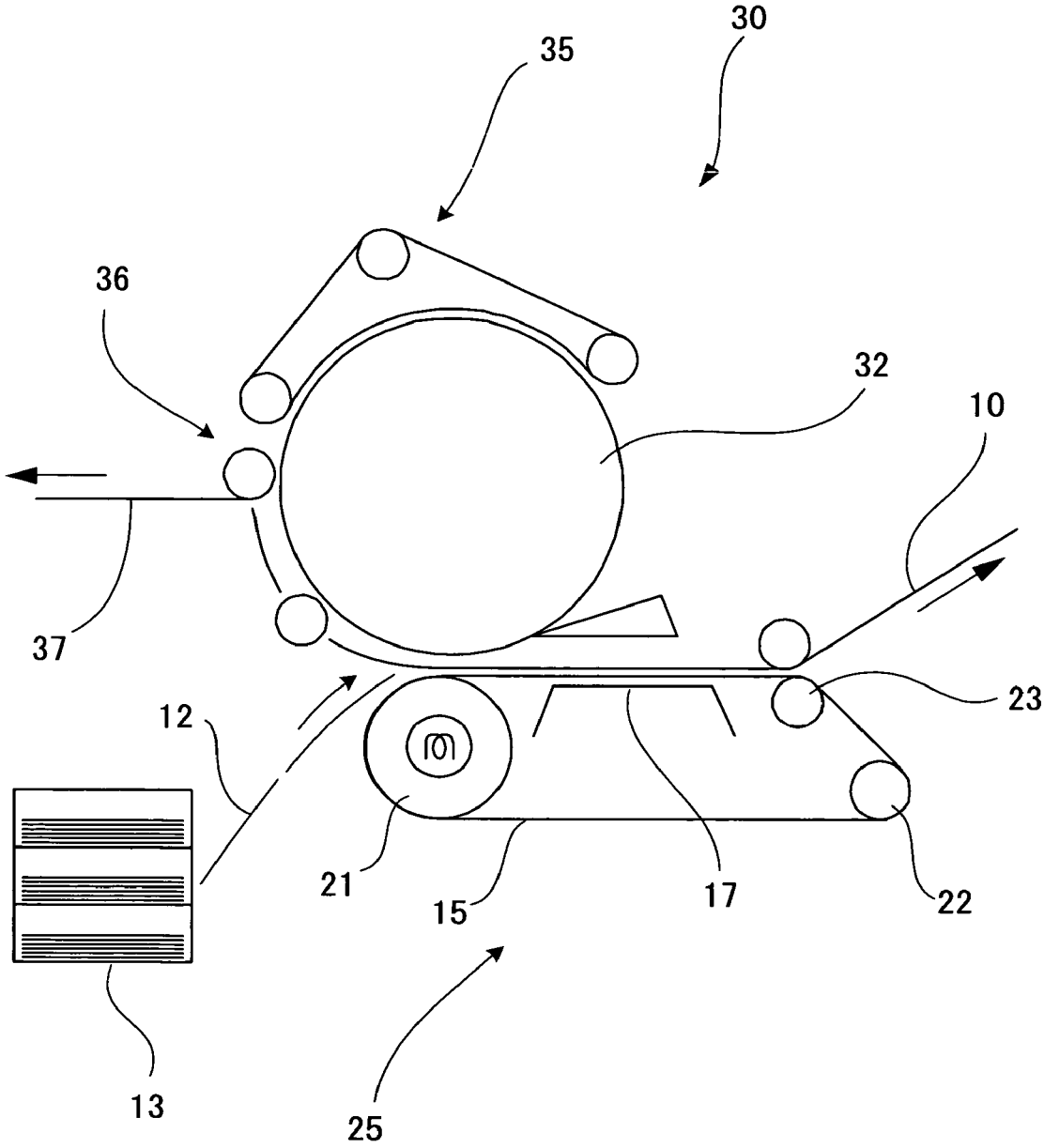
FIG. 10 is a schematic diagram showing an example of an image recording apparatus for hot developing comprising the surface treatment apparatus of the present invention.

FIG. 10 shows an example of an image recording apparatus for hot developing. This image recording apparatus 30 is provided with a surface treatment apparatus 25 after an image recording unit, and performs surface treatment on a sheet after image recording. The sheet 10 is a hot developing sheet shown in FIG. 1 wherein an image recording layer 5 is formed on a support coated with a polyethylene resin layer 3 on both sides of a base paper 1.

Although not shown, the image recording apparatus has a control unit such that, when surface treatment is not to be performed, the sheet avoids and does not pass through the surface treatment apparatus, or if a bypass is provided which does not pass through the surface treatment apparatus, the sheet passes through the bypass.

In an image recording apparatus 30 for hot developing of Example 6 shown in FIG. 10, image recording is performed in a recording part 35 prior to surface treatment. Specifically, a donor 37 is simultaneously exposed to the three colors CMY by a semiconductor laser, not shown, the exposed donor 37 is humidified by a small amount of water, developing is performed by superimposing the sheet 10 and applying heat/pressure by a developing drum 32, and an image is transferred by hot developing from the donor 37 to the sheet 10.

Subsequently, the sheet 10 is separated from the donor 37 by a separating part 36, the used donor is transported to a special tray, and surface treatment is performed by the surface treatment apparatus 25 on the sheet 10 whereupon the image has been recorded.

In Example 6, the surface treatment apparatus has an identical construction to the surface treatment apparatus 25 of Example 5. Identical reference symbols are assigned to identical parts and their description is omitted, but in Example 6, the endless belt 15 is used as the transport unit, the developing drum 32 has the function of the pressure roller, the heat and pressure treatment is preferably performed at 80 to 120° C. which is the temperature at which the thermoplastic resin contained in the sheet softens and becomes deformable, and the pressure is preferably of the order of 7 to 20 kgf/cm$^2$.

As shown in FIG. 10, the contact member selecting unit 13 is disposed downstream of the surface treatment apparatus, and the contact members (texture sheets) 12 which take the form of different sheet types having different surface qualities, are arranged in racks. In this surface treatment apparatus 25, three types of contact members (texture sheets) whereupon three surface qualities, i.e., gloss surface, matt surface and embossed surface are formed, are classified and arranged, so that the surface quality of the contact member can be selected based on user information from the user information processing unit, not shown.

In the image recording apparatus for hot developing in this Example 6, after hot developing transfer is performed by applying heat and pressure with the developing drum 32, heating is performed by the heat roller 21 of the surface treatment apparatus, so the preheating of hot developing transfer can be used, there is little energy wastage, and surface treatment can be performed efficiently.

EXAMPLE 7

An example wherein the surface treatment of the present invention is used in an image recording apparatus for silver halide photography, will now be described.

Figure 11:
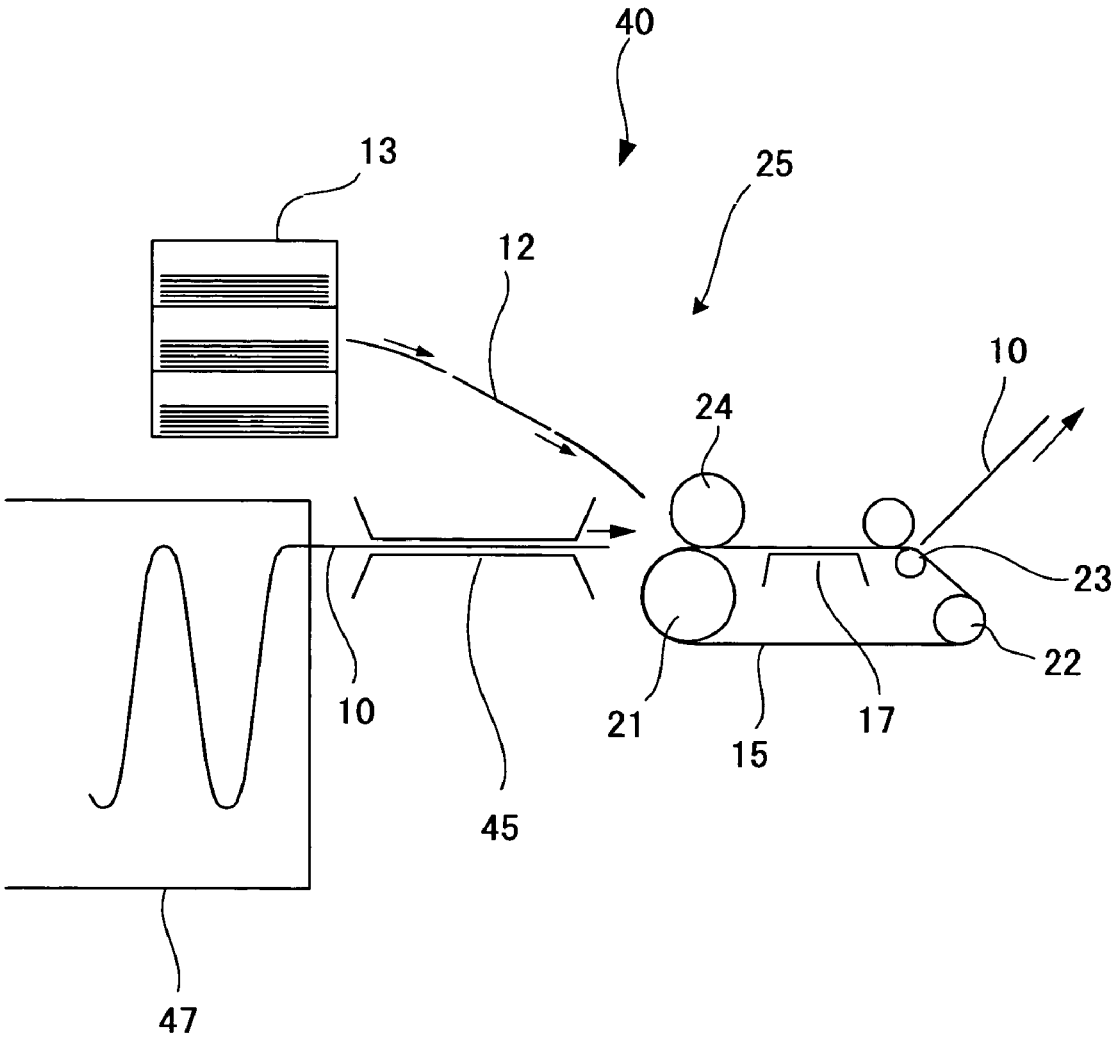
FIG. 11 is a schematic diagram showing an example of an image recording apparatus for silver halide photography comprising the surface treatment apparatus of the present invention.

FIG. 11 shows one example of an image recording apparatus for silver halide photography. This image recording apparatus 40 is provided with a surface treatment apparatus 25 after an image recording unit, and performs surface treatment on a sheet 10 after image recording. The sheet 10 is a silver halide photography sheet shown in FIG. 1 wherein an image recording layer 5 is formed on a support coated with a polyethylene resin layer 3 on both sides of a base paper 1.

Although not shown, the image recording apparatus has a control unit such that, when surface treatment is not to be performed, the sheet avoids and does not pass through the surface treatment apparatus, or if a bypass is provided which does not pass through the surface treatment apparatus, the sheet passes through the bypass.

In an image recording apparatus 40 for silver halide photography of Example 7 shown in FIG. 11, prior to performing surface treatment, a silver halide photography sheet which has been bake-exposed passes through plural processing tanks 47 while being wetted, color developing, bleaching/fixing and water rinse are performed, and after drying in the drying part 45, surface treatment is then performed by the surface treatment apparatus 25. The drying temperature in this drying part 45 is normally 60 to 80° C.

In Example 7, the surface treatment apparatus has an identical construction to the surface treatment apparatus 25 of Example 6. Identical reference symbols are assigned to identical parts and their description is omitted, but in Example 7, the endless belt 15 is used as the transport unit, heat and pressure treatment is preferably performed at 80 to 120° C. which is the temperature at which the thermoplastic resin contained in the sheet softens and becomes deformable, and the pressure is preferably of the order of 7 to 20 kgf/cm$^2$.

As shown in FIG. 11, the contact members selecting unit 13 is connected to the drying part 45, and contact members (texture sheets) 12 which take the form of different sheet types having different surface qualities, are arranged in racks. In this surface treatment apparatus 25, three types of contact members (texture sheets) whereupon three surface qualities, i.e., gloss surface, matt surface and embossed surface are formed, are classified and arranged, so that the surface quality of the contact member can be selected based on user information from the user information processing unit, not shown.

In the surface treatment apparatus for silver halide photography of Example 7, after drying in the drying part 45, heating is performed by the heat roller 21 of the surface treatment apparatus, so the preheating of hot developing transfer can be utilized, energy wastage is small, and surface treatment can be performed efficiently.

EXAMPLE 8

The image recording apparatus according to this example comprises an image recording unit, not shown, and a surface treatment unit.

Figure 12:
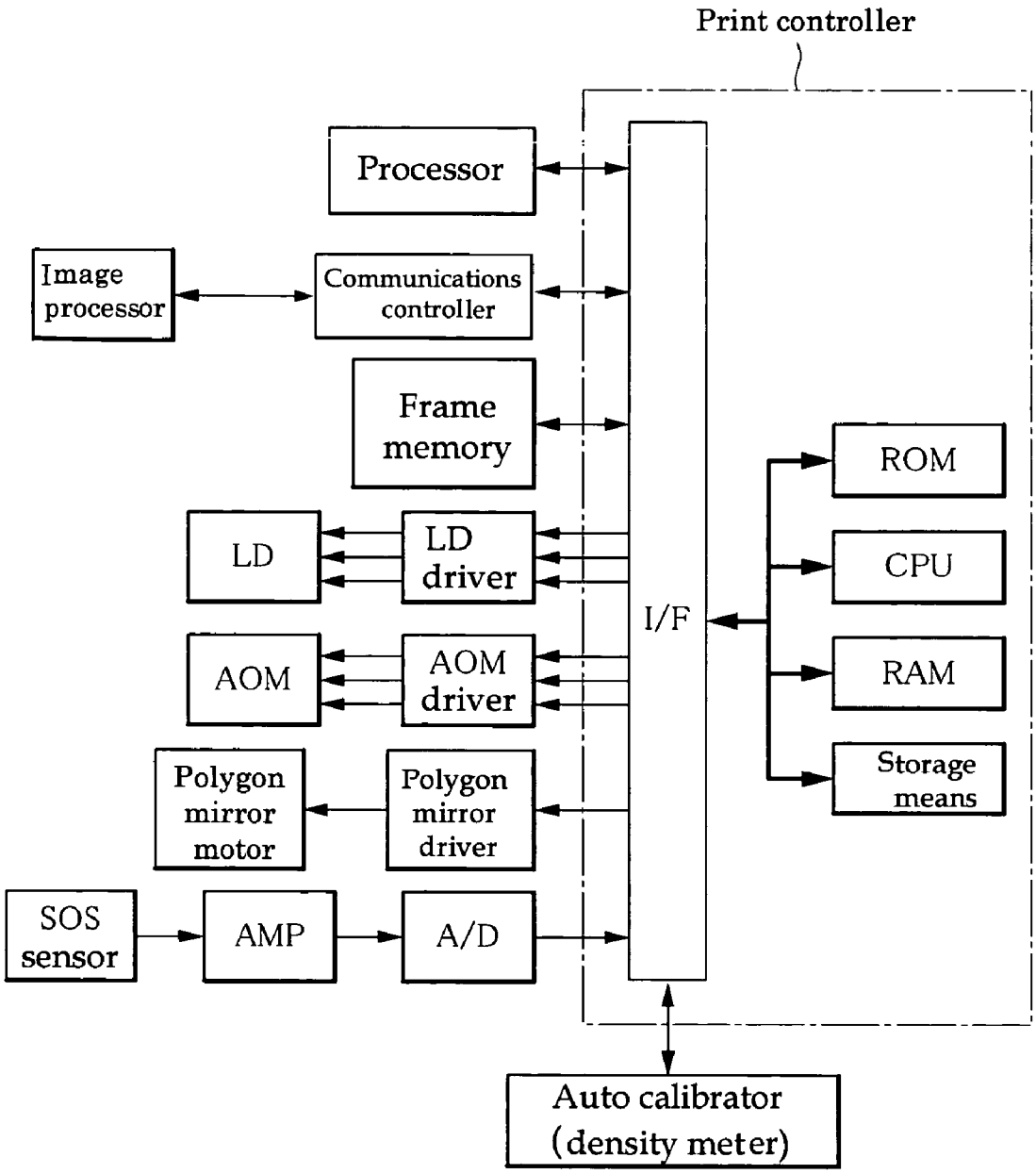
FIG. 12 is a control block diagram of a common silver halide digital photography printing apparatus.

In this example, the image recording unit is a silver halide digital photograph printing apparatus. This silver halide digital photograph printing apparatus is an apparatus known in the art. Specifically, this silver halide digital photograph printing apparatus comprises a magazine connecting part into which a magazine housing an image recording medium can be inserted and fitted, a laser exposure scanner which forms a latent image on the image recording medium based on image data in a frame memory which is an image storage unit, and a processor part which performs developing, bleaching/fixing, water rinse and drying. These are designed so that they can be drive-controlled by a control system shown in FIG. 12. This image recording medium is the aforesaid sheet.

The surface treatment unit is the surface treatment apparatus of the present invention. The surface treatment apparatus is designed so that when it is connected to the eject tray of the aforesaid image recording apparatus, sheets (image recording media) ejected into this eject tray when the surface treatment apparatus is driven are taken inside, and a predetermined surface treatment is performed. Also, the surface treatment apparatus comprises a detection sensor which can detect and identify a magazine ID of a magazine inserted into a magazine insertion part in the image recording apparatus, this detection sensor being disposed in the vicinity of the magazine insertion part in the image recording unit.

Figure 13:
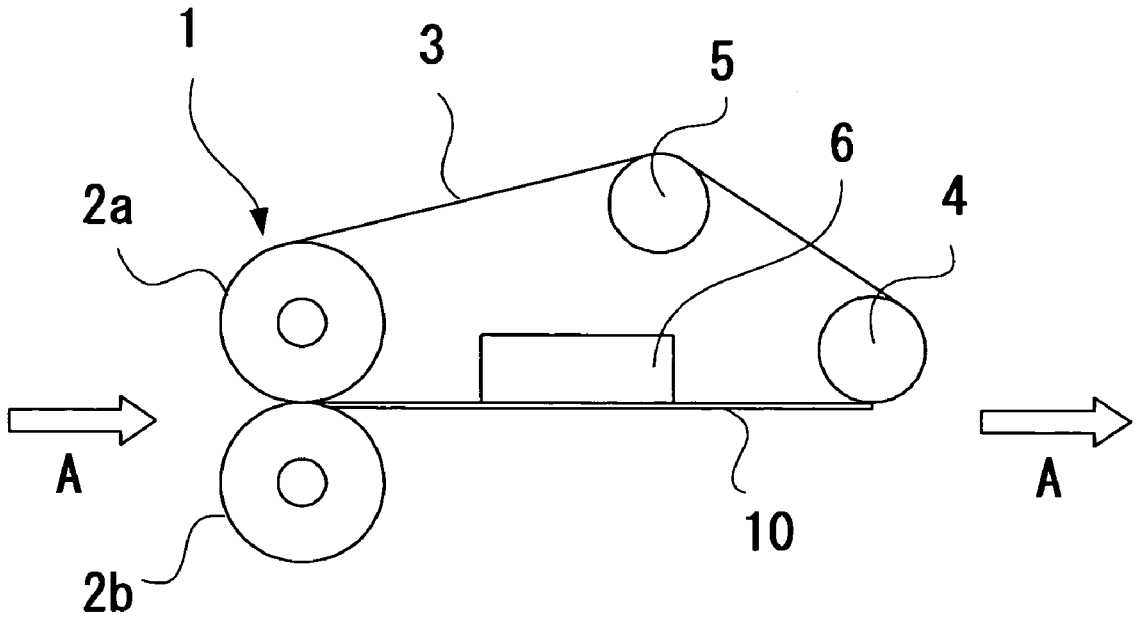
FIG. 13 is a schematic diagram showing an example of the surface treatment apparatus of the present invention.

As shown in FIG. 13, the surface treatment apparatus according to this example comprises a sheet heating unit 1, a sheet cooling unit 6 and a control unit, not shown.

The sheet heating unit 1 comprises a pair of heat rollers 2*a*, 2*b* and an endless belt 3.

The heat rollers 2*a*, 2*b* comprise built-in heaters, and are designed so that the temperature can be freely adjusted. The heat roller 2*a* is disposed on the inner side of the endless belt 3 so that it is free to rotate while in contact with the inner surface of the endless belt 3. The heat roller 2*b* is disposed on the outer side of the endless belt 3 so that it brings the heat roller 2*a* in pressure contact with the outer surface of the endless belt 3, and is free to rotate.

The endless belt 3 has a mirror-finished surface, and is suspended by the heat roller 2*a*, and a rotation roller 4 and suspension roller 5 disposed inside the endless belt 3. The rotation roller 4 and heat roller 2*a* are free to displace in the transport direction A or the opposite direction. The suspension roller 5 is free to displace in an up-down direction when the surface of the endless belt 3 suspended between the heat roller 2*a* and rotation roller 4 is the bottom surface.

According to this example, the sheet cooling unit 6 is a cooling unit provided with an air blowing function, and is disposed inside the endless belt 3 between the heat roller 2*a* and rotation roller 4.

In this surface treatment apparatus, firstly, when operation begins, the sheet 10 to be treated is transported and moved from an eject tray in the image recording apparatus to the interior of the surface treatment apparatus. It then enters the nip part formed between the pair of heat rollers 2*a*, 2*b*. The transport of the sheet up to this point can be performed by a transport roller or transport belt, and according to this example, the design is such that it is performed by a transport roller. The sheet 10 which has entered the nip part comes in contact with the surface of the endless belt 3 which rotates in synchronism with the rotation of the pair of heat rollers 2*a*, 2*b*. The rotation roller 4 and suspension roller 5 may rotate in synchronism with the rotation of the endless belt 3, or may be designed so that they are rotation driven to rotate the endless belt 3 together with the pair of heat rollers 2*a*, 2*b*. According to this embodiment, the rotation roller 4 and suspension roller 5 have the former design.

At this time, due to the heat rollers 2*a*, 2*b*, as shown in FIG. 1, the thermoplastic resin layer of the sheet 10 (in this example, the sheet is an electrophotographic image-receiving sheet, and the thermoplastic resin layer corresponds to a layer (polyethylene resin layer) provided on both sides of a support and an image-receiving layer provided on this layer) is heated to a temperature at which it can soften, and the sheet 10 inserted in the nip part is heated to a temperature at which the thermoplastic resin layer in the nip part softens and becomes deformable. The thermoplastic resin layer in the nip therefore softens, and can deform. At this time, the nip part is subjected to a pressure by the pressure force of the heat roller 2*b*, so the sheet 10 is pressed on both surfaces when it passes through the nip part. When this occurs, the thermoplastic resin layer in the sheet 10 which is in its softest state deforms while under pressure from the pair of heat rollers 1, and both surfaces of the sheet 10 are smoothed. At this time, due to the pressure of the nip part, the sheet 10 passes through the nip part while in intimate contact with the surface of the endless belt 3, and is transported in the transport direction A.

Next, the sheet 10 is cooled by the cooling apparatus 6 while in intimate contact with the surface of the endless belt 3, and the thermoplastic resin layer thereon solidifies. It is thereby transported up to the rotation roller 4. At the rotation roller 4, as the transport direction A of the endless belt 3 changes by 90° or more, the sheet 10 is separated from the surface of the endless belt 3 whereof the transport direction has abruptly changed. The sheet 10 which has separated from the endless belt 3 is than transported in the transport direction by a transport roller, not shown, and ejected to the eject tray, not shown. The surface quality of the endless belt 3 (contact member) is thereby transferred to the interface of the thermoplastic resin layer and surface of the image recording layer of the sheet 10 thus obtained, which becomes a mirror surface with high gloss.

Figure 14:
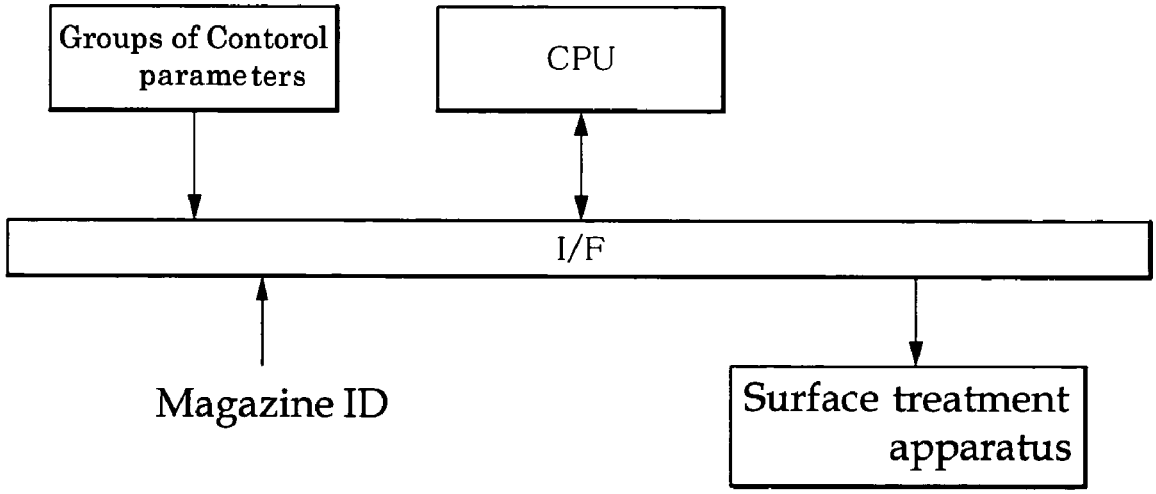
FIG. 14 is a control block diagram showing an example of the surface treatment apparatus of the present invention.

As shown in FIG. 14, in the surface treatment apparatus of this example, a CPU reads corresponding control parameters (treatment modes) via an interface based on the magazine ID information, and controls the operating conditions of the various unit in the surface treatment apparatus as conditions specified by groups of control parameters (treatment modes). These conditions are, for example the heating temperature of the pair of heat rollers 2*a*, 2*b* (when the thickness of the sheet 10 is thick, it is preferred to raise the temperature), the nip pressure (this should be adjusted to be approximately constant even if the thickness of the sheet 10 is thick), the endless belt transport speed (when the heating of the endless belt 3 is not sufficient, or when cooling by the cooling unit 6 is not sufficient, it is preferred to slow the speed), the cold air blowing amount of the cooling apparatus 6, and the distance between the heat roller 2*a* and rotation roller 4 (preferably set to be longer when the treatment surface of the sheet 10 is to be a gloss surface, and set to be shorter when it is to be a matt surface). According to this example, the CPU functions as the aforesaid treatment control unit. Due to the CPU, the operating conditions of the various units in the surface treatment apparatus can be suitably modified, and as a result, in this surface treatment apparatus, a sheet displaying a desired surface state can be obtained under optimum conditions.

Herein, a specific example will be described of treatment where different surface states of the sheet 10 are obtained. FIG. 15 is an example of groups of control parameter files which set the treatment mode. As shown in FIG. 15, for example, three treatment modes can be set. "Luster level 1" is the treatment mode when the surface of the sheet 10 is to be "gloss (high luster)". "Luster level 2" is the treatment mode when the surface of the sheet 10 is to be "matt". "Luster level 3" is the treatment mode when the surface of the sheet 10 is to receive "no treatment".

As shown in FIG. 15, in the treatment mode "Luster level 1", the treatment conditions are to perform surface treatment by the surface treatment unit ("Surface"=YES), to set the temperature of the heat roller 2*a* to 120° C. ("Temp A"=120), to set the temperature of the heat roller 2*b* to 80° C. ("Temp B"=80), to set the temperature of the heat roller 2*b* during continuous treatment to 120° C. ("Temp B"=120), to set the nip pressure between the pair of heat rollers 2*a*, 2*b* to be high ("Press"=High), to set the power of the cooling fan in the cooling apparatus 6 to be high ("Cooling fan"=High), to set the length of the endless belt 3 cooled by the cooling unit to be long ("Belt"=Long), and to set the transport speed of the endless belt 3 to be intermediate ("Speed"=Middle). In the treatment mode ("Luster level 1"), ("Belt"=Long), and the cooling time is sufficient, so the treatment surface becomes a glossy surface (high luster). In the case of this treatment mode, the temperature of the sheet surface is of the order of 70° C.

In the treatment mode "Luster level 2", the treatment conditions are to perform surface treatment by the surface treatment unit ("Surface"=YES), to set the temperature of the heat roller 2*a* to 120° C. ("Temp A"=120), to set the temperature of the heat roller 2*b* to 80° C. ("Temp B"=80), December temperature of the heat roller 2*b* during continuous treatment to 120° C. ("Temp B"=120), to set the nip pressure between the pair of heat rollers 2*a*, 2*b* to be high ("Press"=High), to set the power of the cooling fan in the cooling apparatus 6 to be low ("Cooling fan"=Low), to set the length of the endless belt 3 cooled by the cooling unit to be short ("Belt"=Short), and to set the transport speed of the endless belt 3 to be intermediate ("Speed"=Middle). In the treatment mode ("Luster level 1"), ("Belt"=Short), and the cooling time is not sufficient, therefore the sheet separates from the surface of the endless belt 3 before the thermoplastic resin layer in the sheet has completely solidified, so the treatment surface becomes a matt surface. In the case of this treatment mode, the temperature of the sheet surface is of the order of 95° C.

In the treatment mode "Luster level 3", the treatment conditions are not to perform surface treatment by the surface treatment unit ("Surface"=NO).

In the surface treatment apparatus of this example, the design is such that the three treatment modes can be automatically selected based on the ID of the magazine in which the sheet 10 is housed. In this case, in the surface treatment apparatus, a sensor, not shown, is provided as a magazine ID identification unit which identifies the magazine ID of the magazine housing the sheet, and this sensor may be disposed in a magazine fixing part of the image recording apparatus. When the sensor identifies the magazine ID, the CPU, which is the treatment conditions selecting unit, automatically selects the treatment conditions which have previously been made to correspond with this magazine ID, from among the treatment modes stored in the treatment mode storage unit. The CPU then performs surface treatment based on the treatment conditions set in the aforesaid treatment mode.

At this time, if a relation is pre-established between this magazine ID and the sheet 10 housed in the magazine to which this magazine ID is assigned, different surface treatments can be performed for each magazine ID. For example, even if there is only one type of the sheet 10 (e.g., only glossy photo paper), different surface treatment can be performed for each magazine (however, in this case, at least two magazine ID which are different for different magazines, must be set). On the other hand, even when the sheet 10 is a silver halide photograph sheet, if the product type is different e.g., glossy photo paper, thick matt photo paper or thin matt photo paper), a different surface treatment can be performed for each product type (however, in this case, magazine ID which are different for different magazines, must be set).

As shown in FIG. 16, if the magazine ID are for example A, B, C and Z, on a screen where the CPU displays the treatment mode, when the magazine ID is "A", "Luster level 1" which is the treatment mode for this surface treatment, is selected by the CPU.

When the magazine ID is "B" or "C", "Luster level 2" which is the treatment mode for this surface treatment, is selected by the CPU. When the magazine ID is "Z", "Luster level 3" which is the treatment mode for this surface treatment, is selected by the CPU.

If the screen displayed by the CPU is like the upper part of FIG. 16, the treatment conditions corresponding to the particular treatment mode (control parameter files) may also be displayed on the next screen as shown in the lower part of FIG. 16. These settings may be stored and modified as groups of control parameter files. In this example, when the sensor detects and identifies the magazine ID, the CPU automatically selects the treatment mode based on the identification result and colors the selected treatment mode on the display screen, so the treatment mode in which surface treatment is currently being performed can be visually observed.

Figure 17:
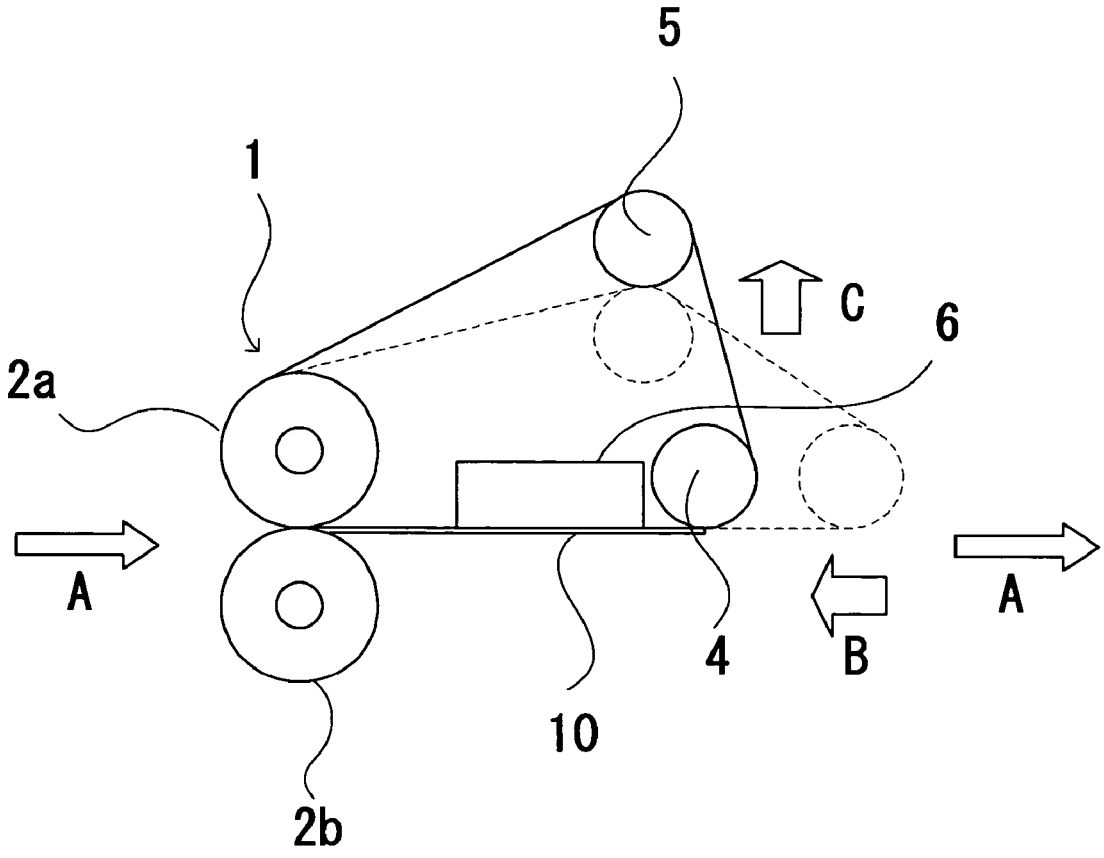
FIG. 17 is a schematic diagram showing an example of cooling condition control in the surface treatment apparatus of the present invention.

The treatment mode "Luster level 1" is the surface treatment for the state shown in FIG. 13, and the treatment mode "Luster level 2" is the surface treatment for the state shown in FIG. 17. For the treatment mode "Luster level 2", the treatment conditions are identical except that ("Cooling fan"=High) is modified to ("Cooling fan"=Low), and ("Belt"=Long) is modified to ("Belt"=Short).

The modification from ("Belt"=Long) to ("Belt"=Short) may for example be performed as follows. As s shown in FIG. 17, the CPU shortens the distance between the heat roller 2*a* and rotation roller 4 by moving the rotation roller 4 towards the heat roller 2*a* (direction of the arrow B). At this time, the suspension force (tension) of the endless belt 3 is no longer sufficient, but the suspension roller 5 moves upwards (arrow C), so the suspension force (tension) of the endless belt 3 is suitably maintained. When the distance between the heat roller 2*a* and rotation roller 4 is shortened, the time for which the sheet 10 is cooled by the cooling apparatus 6 as it is transported in contact with the surface of the endless belt 3, becomes shorter. Also, the modification from ("Cooling fan"=High) to ("Cooling fan"=Low) can be performed by the CPU decreasing the cold air blow amount which can be blown by the cooling apparatus 6.

In the aforesaid examples, the quality after surface treatment was made to correspond with the magazine ID detected and identified by the sensor, but the sheet type may be made to correspond with the ID. In this case, plural groups of control parameter files in the treatment modes shown in FIG. 15 are provided for each of the aforesaid magazine ID, the quality (luster selection) after surface treatment is selected by the operator as shown in FIG. 18A and FIG. 18B, and the treatment mode ("Luster level 1") of surface treatment is made to correspond with the quality after surface treatment. Even for an identical quality after surface treatment, if the sheet type is different, the heat amount or water content amount differs due to paper thickness, so the value of the treatment mode stored in the control parameter file is different. According to this example, when the sensor detects and identifies the magazine ID, the CPU selects the control parameter file of the treatment mode corresponding to the magazine ID based on the identification result, and selects the treatment mode of surface treatment based on the quality after surface treatment selected by the operator. In this case, the number of magazines can be reduced.

As shown in FIG. 18A and FIG. 18B, the design may be such that the operator can freely input a paper selection and gloss selection on a screen displayed by the CPU as an operator screen display unit, and based on the input information, the CPU can select the treatment mode and perform surface treatment under treatment conditions set in this treatment mode.

Figure 19:
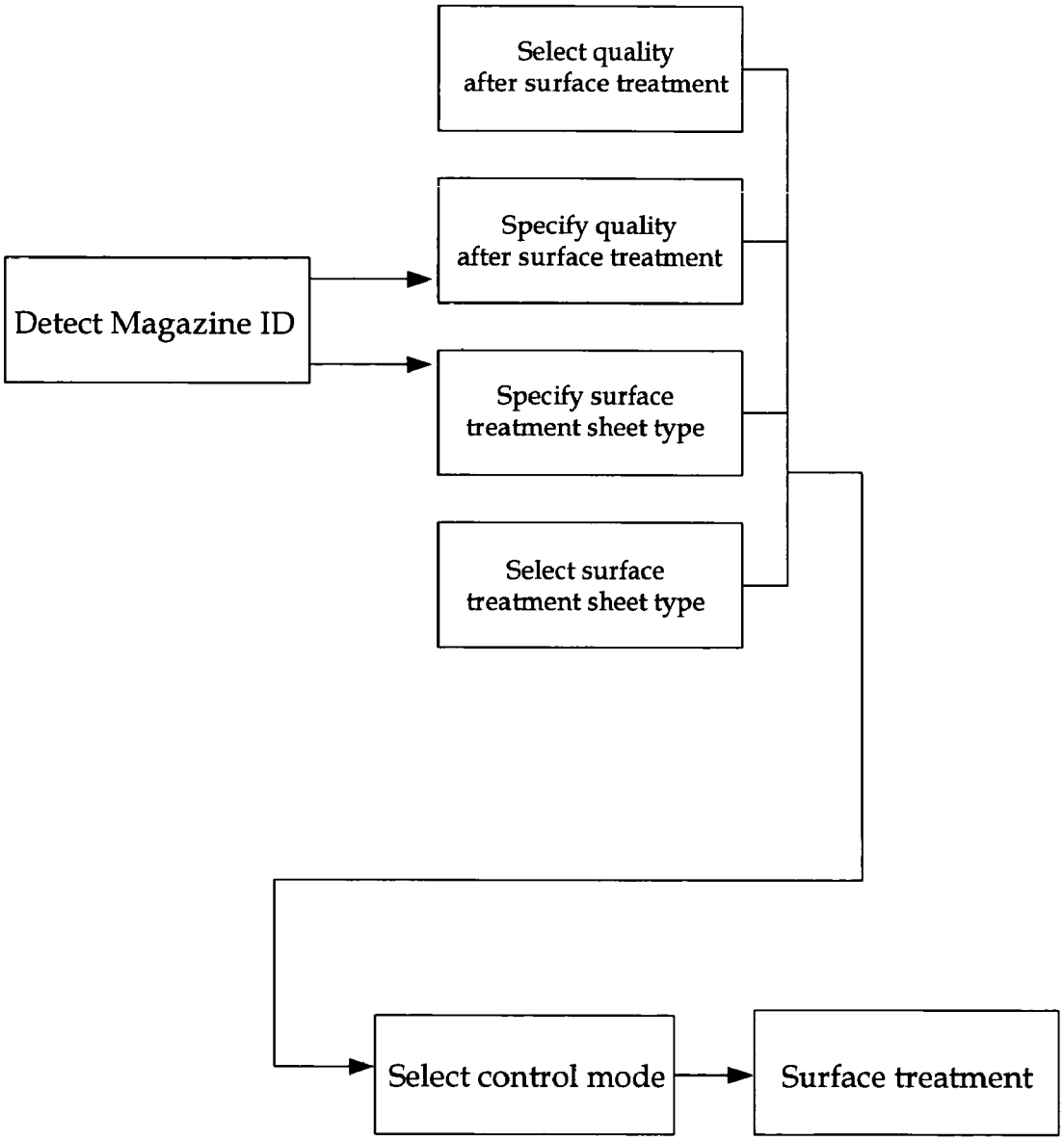
FIG. 19 is a schematic diagram showing the control flow of the surface treatment apparatus of the present invention.

Hence, surface treatment is performed corresponding to the treatment mode which is automatically selected or manually input (FIG. 19), and an image having a surface luster corresponding to the treatment mode is obtained. Even for the same sheet type, an image having a different surface luster can be obtained simply by changing the treatment mode. Also, even for different sheet types, an image having the same surface luster can be obtained simply by selecting the treatment mode.

Further, fine adjustment of treatment conditions based on surface treatment environmental conditions can be performed simply by making additional settings of correction conditions based on the environmental conditions in the treatment mode.

According to the present invention, the problems inherent in the prior art are resolved, and a surface treatment apparatus which can easily and simply impart a desired luster to surface of an image print obtained by various image recording methods, and an image recording apparatus wherein an image having a desired surface luster can easily be formed, are provided.

EXAMPLE 9

The image recording apparatus according to this example comprises an image recording unit, not shown, and a surface treatment unit. Although not shown, the image recording apparatus has a control unit such that, when surface treatment is not to be performed, the sheet avoids and does not pass through the surface treatment apparatus, or if a bypass is provided which does not pass through the surface treatment apparatus, the sheet passes through the bypass.

In this example, the image recording unit is a silver halide digital photograph printing apparatus. This silver halide digital photograph printing apparatus is an apparatus known in the art. Specifically, this silver halide digital photograph printing apparatus comprises a magazine connecting part into which a magazine housing an image recording medium can be inserted and fitted, a laser exposure scanner which forms a latent image on the image recording medium based on image data in a frame memory which is an image storage unit, and a processor part which performs developing, bleaching/fixing, water rinse and drying. These are designed so that they can be drive-controlled by a control system. This image recording medium is the aforesaid sheet.

The surface treatment unit is the surface treatment apparatus of the present invention. The surface treatment apparatus is designed so that when it is connected to the eject tray of the aforesaid image recording apparatus, sheets (image recording media) ejected into this eject tray when the surface treatment apparatus is driven are taken inside, and a predetermined surface treatment is performed.

Figure 20:
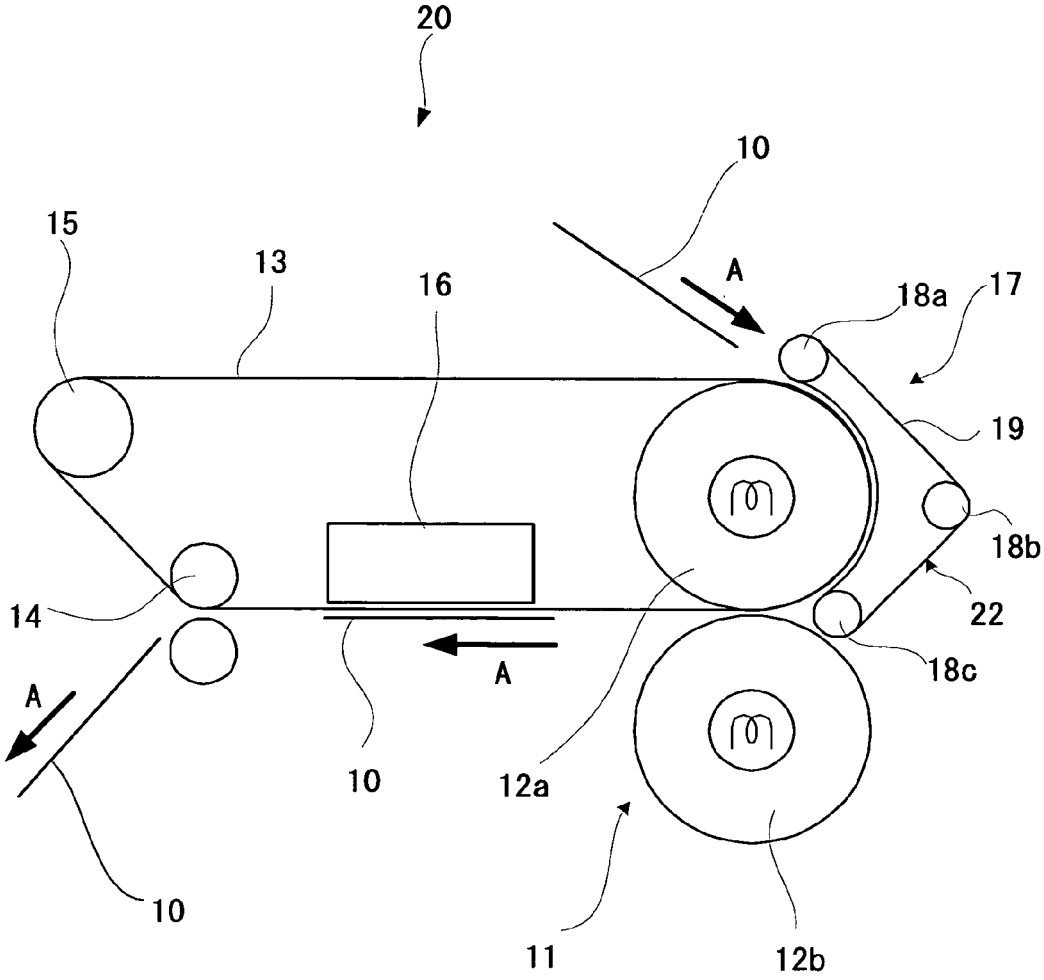
FIG. 20 is a schematic diagram showing an example of the surface treatment apparatus of the present invention.

As shown in FIG. 20, the surface treatment apparatus 20 according to this example comprises a sheet heating unit 11 and a sheet cooling unit 16.

The sheet heating unit 11 comprises an inner heat roller 12*a* disposed on the inner side of the endless belt 13 which suspends the endless belt 13 such that it is free to rotate together with the rotation roller 14 and suspension roller 15 disposed on the inner side of the endless belt 13, and an outer heat roller 12*b* disposed on the outer side of the endless belt which grips the endless belt such that it is free to rotate together with the inner heat roller 12*a*.

The sheet preheating unit 17 comprises the inner heat roller 12*a*, three rotation rollers 18*a*, 18*b* and 18*c*, and a transport unit 22 comprising an endless belt 19 suspended free to rotate together with these three rotation rollers. The transport unit 22 is disposed so that the inner heat roller 12*a* in the sheet heating unit and the endless belt 13 are pressed from their outer side.

The inner heat roller 12*a* and outer heat roller 12*b* comprise built-in heaters, and are designed so that the temperature can be freely adjusted.

The endless belt 13 is finished with a desired surface quality (one of a gloss surface, matt surface and embossed surface), and is suspended by the inner heat roller 12*a*, and the rotation roller 14 and suspension roller 15 disposed inside the endless belt 13.

According to this example, the sheet cooling unit 16 is a cooling unit provided with an air blowing function, and is disposed inside the endless belt 13 between the inner heat roller 12*a* and rotation roller 14.

In this surface treatment apparatus, when the apparatus is driven, the sheet 10 to be treated is first transported to the sheet preheating part 17 in the surface treatment apparatus from an eject tray in the image recording apparatus. The sheet 10 inserted in the sheet preheating part 17, then passes through the sheet heating part 17 while the thermoplastic resin layer in the sheet 10 shown in FIG. 1 is heated to the temperature at which it softens and becomes deformable by the inner heat roller 12*a*, which is in contact with the surface of the endless belt 13 and applies pressure contact to the endless belt 13 from its inner side (in this example, the sheet is an electrophotographic image-receiving paper, and the thermoplastic resin layer corresponds to the layer 3 (polyethylene resin layer) provided on both sides of the support, and the image recording layer 5 provided on this layer).

The sheet 10 preheated by the sheet heating part 17 then enters the nip part formed between the inner heat roller 12*a* and outer heat roller 12*b* (pair of heat rollers). The sheet 10 which has entered the nip part comes in contact with the surface of the endless belt 13 which rotates in synchronism with the rotation of the pair of heat rollers 12*a*, 12*b*. The rotation roller 14 and suspension roller 15 may rotate in synchronism with the rotation of the endless belt 13, or may be designed so that they are rotation driven to rotate the endless belt 13 together with the pair of heat rollers 12*a*, 12*b*. According to this embodiment, the rotation roller 14 and suspension roller 15 have the former design.

At this time, the pair of heat rollers 12*a*, 12*b* heat the thermoplastic resin layer in the sheet 10 to a temperature at which it can soften, and while the sheet 10 heated to a temperature at which the thermoplastic resin can soften by the sheet preheating part 17, is inserted in the nip part, the thermoplastic resin layer softens and becomes deformable. At this time, the nip part is subjected to a pressure by the pressure force of the outer heat roller 12*b*, so the sheet 10 is pressed on both surfaces when it passes through the nip part. The thermoplastic resin layer in the sheet 10 which is now in its softest state then deforms under pressure by the pair of heat rollers 12*a*, 12*b*, and a desired surface quality is transferred to the treatment surface of the sheet 10. At this time, due to the pressure of the nip part, the sheet 10 passes through the nip part while in intimate contact with the surface of the endless belt 13, and is transported in the transport direction A.

Next, the sheet 10 is cooled by the cooling apparatus 16 while in intimate contact with the surface of the endless belt 13, and the thermoplastic resin layer thereon solidifies. It is thereby transported up to the rotation roller 14. At the rotation roller 14, as the transport direction A of the endless belt 13 changes by 90° or more, the sheet 10 is separated from the surface of the endless belt 13 whereof the transport direction has abruptly changed. The sheet 10 which has separated from the endless belt 13 is than transported in the transport direction by a transport roller, not shown, and ejected to the eject tray, not shown. The surface quality (one of gloss surface, matt surface and embossed surface) of the contact belt 13 (contact member) is transferred to the interface with the thermoplastic resin layer and the surface of the image recording layer, of the sheet 10 thus obtained.

EXAMPLE 10

Figure 21:
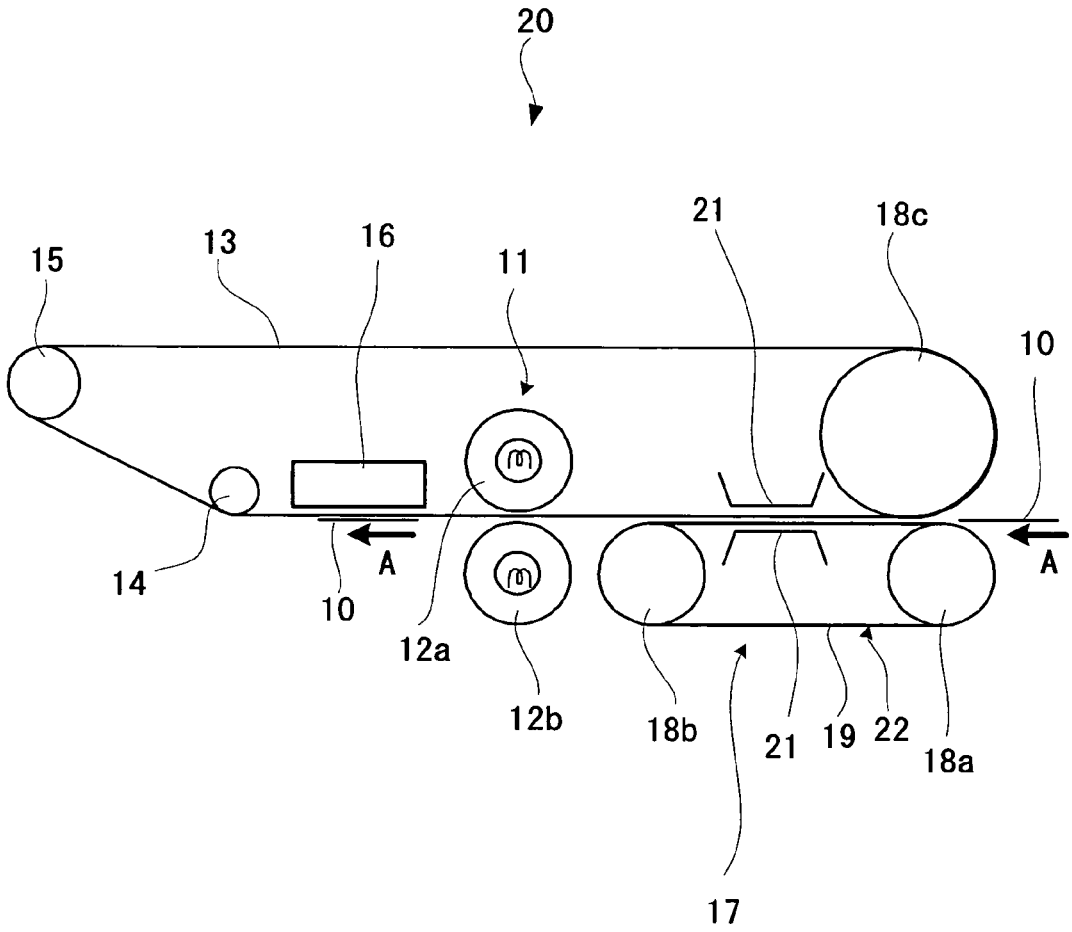
FIG. 21 is a schematic diagram showing another example of the surface treatment apparatus of the present invention.

The surface treatment unit in Example 9 is replaced by the surface treatment unit 20 shown in FIG. 21. In this surface treatment unit 20, the transport unit 22 in the sheet preheating part comprises the two rotation rollers 18*a*, 18*b*, and the contact belt 19 suspended free to rotate together with these two rotation rollers, is situated further upstream than the inner heat roller 12*a* and outer heat roller 12*b* (pair of heat rollers), and applies pressure contact to the endless belt 13 which is finished with a desired surface quality (one of a gloss surface, matt surface and embossed surface) in the sheet heating unit.

The transport unit 22 of this example comprises an internal heating mechanism 21 (e.g., a pair of heaters disposed on the inner side of the contact belt 19 suspended between the two rotation rollers 18*a*, 18*b*). In this way, the heat amount required when the heating of the sheet transfers (forms) the surface quality of the contact member due to the pair of heat rollers, is less, insufficient heating is avoided, and the sheet treatment surface can be placed in a softened state or molten state without fail.

The surface quality (one of a gloss surface, matt surface and embossed surface) of the endless belt 13 (contact member) is thereby transferred to the interface of the thermoplastic resin layer and image recording layer surface of the sheet 10 obtained by an identical surface treatment to that of Example 9.

EXAMPLE 11

Figure 22:
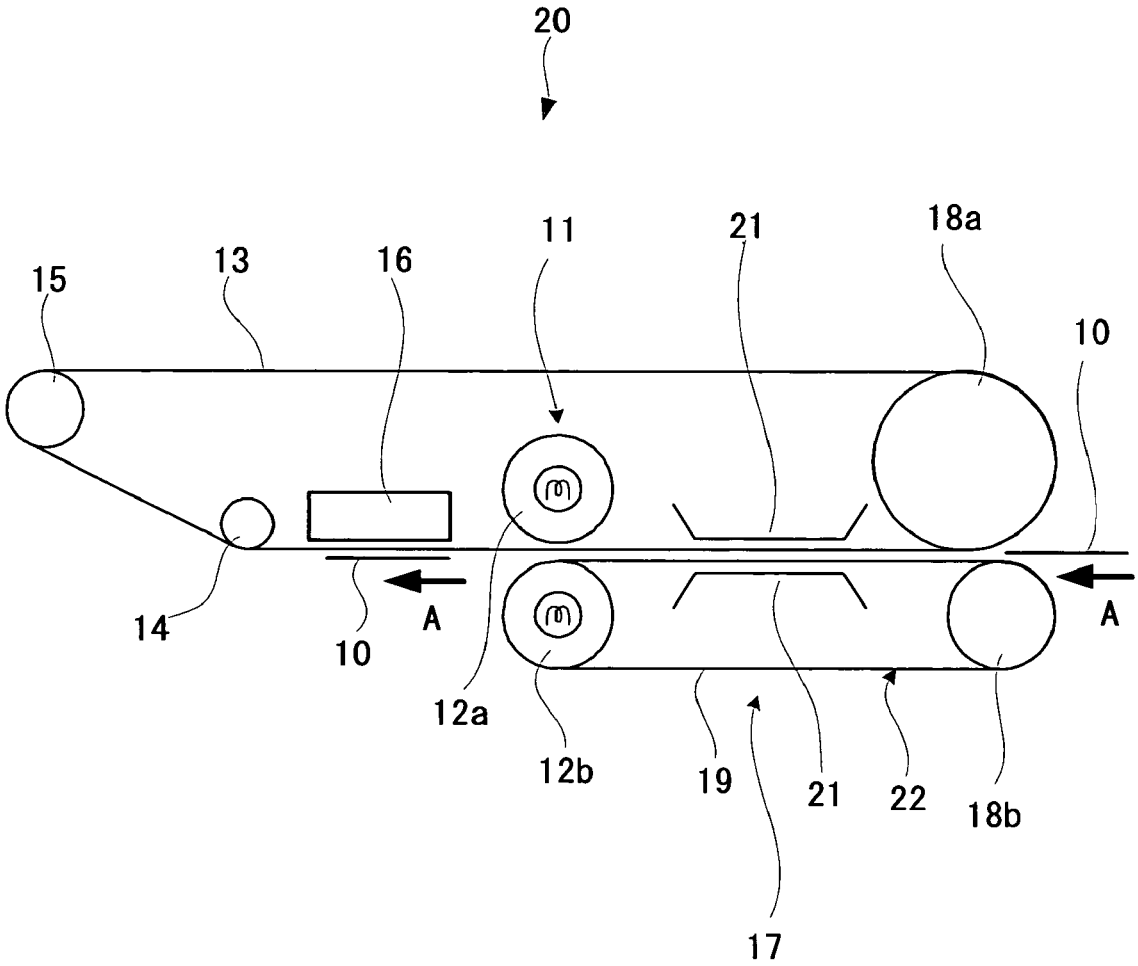
FIG. 22 is a schematic diagram showing another example of the surface treatment apparatus of the present invention.

The surface treatment unit in Example 9 is replaced by the surface treatment unit 20 shown in FIG. 22. In this surface treatment unit 20, the transport unit 22 in the sheet preheating part comprises the two rotation rollers 18*a*, 12*b*, and the contact belt 19 suspended free to rotate together with these two transport rollers, is situated further upstream than the inner heat roller 12*a* and outer heat roller 12*b* (pair of heat rollers), and applies pressure contact to the endless belt 13 which is finished with a desired surface quality (one of a gloss surface, matt surface and embossed surface) in the sheet heating unit.

According to this example, the outer heat roller 12*b* is used as a transport roller situated further downstream in the sheet transport direction of the two rotation rollers. Hence, the construction of the surface treatment unit is simplified, and preheating can be performed adequately and without fail in the sheet preheating part.

The transport unit 22 of this example comprises an internal heating mechanism 21 (e.g., a pair of heaters disposed on the inner side of the contact belt 19 suspended between the two rotation rollers 18*a*, 18*b*). In this way, the heat amount required when the heating of the sheet transfers (forms) the surface quality of the contact member due to the pair of heat rollers, is less, insufficient heating is avoided, and the sheet treatment surface can be placed in a softened state or molten state without fail.

The surface quality (one of a gloss surface, matt surface and embossed surface) of the endless belt 13 (contact member) is thereby transferred to the interface of the thermoplastic resin layer and image recording layer surface of the sheet 10 obtained by an identical surface treatment to that of Example 9.

One example of the image recording apparatus of the present invention has been described in detail, but it should be understood that the invention is not be construed as being limited in any way thereby, various modifications being possible within the scope and spirit of the appended claims.

According to the present invention, a surface treatment apparatus which can impart a desired surface quality to the surface of an image print obtained by various image recording methods such as silver halide photography, hot developing, inkjet recording, thermosensitive recording and electrophotography, and an image recording apparatus comprising this surface treatment apparatus which can easily form an image having a desired surface quality, are provided.

Some examples of the surface treatment apparatus and image recording apparatus of the present invention have been described in detail, but it should be understood that the invention is not be construed as being limited in any way thereby, various modifications being possible within the scope and spirit of the appended claims.

The surface treatment apparatus of the present invention performs a desired surface treatment (forms surface depressions and protrusions) according to user requirements, on an image recording layer surface and the interface between the thermoplastic resin layer and image recording layer in a sheet, and as a result, a desired gloss can easily and efficiently be imparted to the sheet surface. Further, the image recording apparatus of the present invention comprises the surface treatment apparatus of the present invention, and is thus suitable for any of an inkjet sheet, thermosensitive recording sheet, hot developing sheet, electrophotographic sheet and silver halide photography sheet.

What is claimed is:

1. A method of surface treatment, comprising:

providing a sheet comprising at least a base, a thermoplastic layer disposed on the base, and an image recording layer disposed on a top surface of the thermoplastic resin layer, arranged to form an interface between a bottom surface of the image recording layer and the top surface of the thermoplastic resin layer;

providing a contact member having a surface quality;

heating the sheet, including heating the thermoplastic resin layer to a predetermined softening temperature;

transferring, by the contact member, the contact member surface quality to the top surface of the thermoplastic later and to the interface between the top surface of the thermoplastic resin layer and the bottom surface of the image recording layer of the sheet; and cooling the sheet while in contact with the contact member.

2. The method of surface treatment according to claim 1, wherein said providing a contact member having a surface quality comprises:

providing a plurality of contact members having corresponding respective, mutually different, surface qualities;

selecting a contact member having a desired surface quality from among said plurality of contact members.

3. The method of surface treatment according to claim 2, wherein the contact member is from the group consisting of a roller, an endless belt, and a texture sheet.

4. The method of surface treatment according to claim 2, wherein said different surface qualities include a gloss quality, a matt quality and an embossed quality.

5. The method of surface treatment according to claim 2, wherein said selecting includes receiving a user information identifying the surface quality of the selected contact member.

6. The method of surface treatment according to claim 5, wherein the providing a plurality of contact members having corresponding respective, mutually different, surface qualities includes providing a contact member selecting unit having said plurality of different contact members, and wherein the selecting is carried out by the contact member selecting unit based on the user information received.

7. The method of surface treatment according to claim 6, wherein the providing a plurality of contact members including providing a contact member selecting unit includes providing a belt having a plurality of different surface patterns at a respective plurality of positions of the belt, wherein said selecting a contact member having a desired surface quality includes detecting a position of the belt associated with the desired surface quality, and wherein the selecting is carried out based on the detecting and on the user information received.

* * * * *